US008379063B2

(12) United States Patent
Budni et al.

(10) Patent No.: US 8,379,063 B2
(45) Date of Patent: Feb. 19, 2013

(54) FINE BRIGHTNESS CONTROL IN PANELS OR SCREENS WITH PIXELS

(75) Inventors: Anand Budni, San Jose, CA (US); Donald A. Krall, San Jose, CA (US)

(73) Assignee: Prysm, Inc., San Jose, CA (US)

( * ) Notice: Subject to any disclaimer, the term of this patent is extended or adjusted under 35 U.S.C. 154(b) by 0 days.

(21) Appl. No.: 13/007,505

(22) Filed: Jan. 14, 2011

(65) Prior Publication Data

US 2012/0169777 A1 Jul. 5, 2012

(51) Int. Cl.
*G09G 5/10* (2006.01)

(52) U.S. Cl. ..... 345/690; 345/84

(58) Field of Classification Search ..... 345/690, 345/84

See application file for complete search history.

(56) References Cited

U.S. PATENT DOCUMENTS

2010/0073600 A1* 3/2010 Itoh et al. ..... 349/65
2011/0051006 A1* 3/2011 Iisaka et al. ..... 348/671

FOREIGN PATENT DOCUMENTS

EP 0526045 A2 3/1993
WO WO0146940 6/2001
WO WO2006107720 10/2006

* cited by examiner

*Primary Examiner* — Yong H Sim
(74) *Attorney, Agent, or Firm* — Perkins Coie LLP

(57) ABSTRACT

Techniques and devices use panels or screens with pixels for display or illumination applications to achieve dithered pixel brightness beyond pixel brightness levels set by a digital to analog conversion (DAC) circuit module with a preset DAC resolution between two adjacent DAC levels. In one implementation, when a pixel is to be dictated by a digital pixel signal to operate within an unstable brightness region, a control mechanism is provided to control the DAC circuit module to operate the pixel in the block at a DAC level below the unstable brightness region or at a different DAC level above the respective unstable brightness region, to achieve a perceived brightness level within the respective unstable brightness region.

27 Claims, 29 Drawing Sheets

Pixelated Display Array

Unit Cell of 4 Adjacent Pixels With Each Pixel Operated at Respective DAC Levels Temporal integration over 2 or more sequential frames within a unit cell

*Scanning Excitation Light With Pixelated Light-Emitting Screen*

*Scanning Light With Passive Transissive/Diffusive Uniform Screen*

*Scanning Light With Passive Reflective Uniform Screen*

*Direct Light-Emitting Display (LED Arrays, OLED Arrays, etc.)*

PULSE WIDTH MODULATION FOR 128 GREY LEVELS

FINE BRIGHTNESS CONTROL IN PANELS OR SCREENS WITH PIXELS

CROSS-REFERENCE TO RELATED APPLICATION

This patent document claims the benefit of priority of Great Britain Patent Application No. 1100056.9 entitled "FINE BRIGHTNESS CONTROL IN PANELS OR SCREENS WITH PIXELS" and filed on Jan. 4, 2011, which is incorporated by reference as part of the disclosure of this document.

BACKGROUND

This patent document relates to techniques and devices that use panels or screens with pixels for display or illumination applications.

Various display or illumination applications use a panel or screen with pixilated structures, such as a light-emitting-diode (LED) array or an organic LED array formed of LED pixels, to operate individual pixels to produce desired optical brightness levels. In certain such applications, it is desirable to provide fine control over the brightness levels of the pixels to achieve certain display or illumination effects or quality.

SUMMARY

Techniques and devices are provided to control brightness of panels or screens with pixels for display or illumination applications. Panels or screens can be operated achieve dithered pixel brightness beyond pixel brightness levels set by a digital to analog conversion (DAC) circuit module with a preset DAC resolution between two adjacent DAC levels.

In one aspect, a device for producing light at different pixels on a panel is provided to include a panel; a digital controller that produces digital pixel signals that represent, respectively, pixel brightness levels of pixels on the panel; and a digital to analog conversion (DAC) circuit module configured to have preset DAC levels and coupled to the digital controller to receive the digital pixel signals. The DAC circuit module is operable to convert the digital pixel signals into analog pixel signals at respective DAC levels. This device includes a light producing module that receives the analog pixel signals to cause illumination of individual pixels on the panel based on respective DAC levels of the pixels, wherein the illumination of each individual pixel exhibits a stable brightness region in which each pixel produces stable illumination and an unstable brightness region in which each pixel produces unstable illumination. This device includes a control mechanism that controls a block of a predetermined size of adjacent pixels on the panel to selectively operate the DAC circuit module to cause one or more pixels in the block at a first DAC level and one or more other pixels in the block at a second DAC level different from the first DAC level to achieve a perceived average brightness level for the block between a first brightness level corresponding to the first DAC level and a second brightness level corresponding to the second DAC level. The control mechanism further controls the DAC circuit module, when a pixel within the block is to be dictated by a digital pixel signal to operate within a respective unstable brightness region, to operate one or more pixels in the block at a DAC level below the unstable brightness region and one or more other pixels in the block at a different DAC level above the respective unstable brightness region, to achieve a perceived brightness level within the respective unstable brightness region.

In another aspect, a device for producing light at different pixels on a screen is provided to include one or more light sources that produce one or more optical beams, each of the one or more light sources exhibiting a stable brightness region in which a respective light source produces stable illumination and an unstable brightness region in which a respective light source produces unstable illumination; and a signal modulation controller in communication with the one or more light sources to cause the one or more optical beams to be modulated as optical pulses that carry images to be displayed, the signal modulation controller including a digital controller that produces digital pixel signals that represent, respectively, pixel brightness levels of pixels on the panel and a digital to analog conversion (DAC) circuit module configured to have a preset DAC resolution between two different DAC levels and coupled to the digital controller to receive the digital pixel signals. The DAC circuit module is operable to convert the digital pixel signals into analog pixel signals at respective DAC levels. This device includes a screen that receives the one or more optical beams to display images carried by the optical beams; and an optical scanning module that scans the one or more optical beams onto the screen to direct the optical pulses onto respective pixel positions on the screen to produce respective pixel brightness levels. In this device, the digital controller controls a block of a predetermined size of adjacent pixels on the panel to selectively operate one or more pixels in the block at a first DAC level and one or more other pixels in the block at a second DAC level next to the first DAC level to achieve a perceived average brightness level for the block between a first brightness level corresponding to the first DAC level and a second brightness level corresponding to the second DAC level. The digital controller further controls the DAC circuit module, when a pixel is to be dictated by a digital pixel signal to operate within the unstable brightness region of the one or more light sources, to operate one or more pixels in the block at a DAC level below the unstable brightness region and one or more other pixels in the block at a different DAC level above the respective unstable brightness region, to achieve a perceived brightness level within the respective unstable brightness region.

In another aspect, a method for controlling brightness of pixels on a panel is provided to include providing digital pixel signals that represent, respectively, pixel brightness levels of pixels on a panel; operating a digital to analog conversion (DAC) circuit module that has preset DAC levels to convert the digital pixel signals into analog pixel signals at respective DAC levels; applying the analog pixel signals to cause illumination of individual pixels on the panel based on respective DAC levels of the pixels, wherein each individual pixel exhibits a stable brightness region in which each pixel produces stable illumination and an unstable brightness region in which each pixel produces unstable illumination; and selecting at least one pixel on the panel to operate the pixel at, at least, a first DAC level outside the unstable brightness region in a first frame and a second DAC level different from the first DAC level and outside the unstable brightness region at a second frame at a time after the first frame, to achieve a perceived brightness level for the pixel, which is collectively produced by combining the first and second frames, to be between a first brightness level corresponding to the first DAC level and a second brightness level corresponding to the second DAC level. When a perceived brightness level for a pixel is to be at a level within a respective unstable region, the first DAC level is selected to be below the unstable region and the second DAC level is outside is selected to be above the unstable region.

In another aspect, a device for producing light at different pixels on a panel is provided to include a panel; a digital controller that produces digital pixel signals that represent, respectively, pixel brightness levels of pixels projected onto or formed on the panel; and a digital to analog conversion (DAC) circuit module configured to have preset DAC levels and coupled to the digital controller to receive the digital pixel signals. The DAC circuit module is operable to convert the digital pixel signals into analog pixel signals at respective DAC levels. This device includes a light producing module to receive the analog pixel signals from the DAC circuit module and to cause illumination of individual pixels on the panel based on respective DAC levels of the pixels, wherein each individual pixel exhibits a stable brightness region in which each pixel produces stable illumination and an unstable brightness region in which each pixel produces unstable illumination. This device includes a control mechanism that selects at least one pixel on the panel to operate the pixel at, at least, a first DAC level outside the unstable region in a first frame and a second DAC level outside the unstable region and different from the first DAC level at a second frame at a time after the first frame, to achieve a perceived brightness level for the pixel collectively produced by combining the first and second frames to be between a first brightness level corresponding to the first DAC level and a second brightness level corresponding to the second DAC level. When a perceived brightness level for a pixel is to be at a level within a respective unstable region, the control mechanism selects the first DAC level to be below the unstable region and the second DAC level to be above the unstable region.

In another aspect, a method for controlling brightness on a display device is provided to include providing an array of spatial frame imaging data values, where the imaging data values comprise renderable color and intensity values in a temporal construct per frame, where the intensity value instance is an intensity level driving a intensity illumination source, and where the intensity illuminating source renders one or more imaging data values within the frame and exhibits a stable brightness region in which the intensity illumination source produces stable output and an unstable brightness region in which the intensity illumination source produces unstable output. This method includes operating an intensity driver circuit module that has a preset intensity resolution between two adjacent intensity levels to convert the imaging data into a target intensity level; applying the target intensity level to cause illumination of individual imaging data values on the display based on respective DAC levels of the pixels; and controlling a block of a predetermined size of adjacent pixels on the panel to selectively operate one or more pixels in the block at a first DAC level outside the unstable brightness region and one or more other pixels in the block at a second DAC level different from the first DAC level and outside the unstable brightness region to achieve a perceived average brightness level for the block within the unstable brightness region. In one implementation, this method can further include generating the digital pixel signals for two or more sequential frames to produce an averaged frame from the two or more sequential frames, the averaged frame including one or more predetermined sized blocks of adjacent pixels on the panel to achieve a perceived average brightness level for each block between two brightness levels that correspond to the two different DAC levels.

In another aspect, a digital to analog conversion (DAC) circuit module with preset DAC levels can be used to convert digital pixel signals into analog pixel signals at respective DAC levels to cause illumination of individual pixels on the panel based on respective DAC levels of the pixels. A block of a predetermined size of adjacent pixels on the panel is controlled to selectively operate one or more pixels in the block at a first DAC level and one or more other pixels in the block at a second DAC level different from the first DAC level to achieve a perceived average brightness level for the block between a first brightness level corresponding to the first DAC level and a second brightness level corresponding to the second DAC level.

In another aspect, a method for controlling brightness of pixels on a panel is provided to include providing digital pixel signals that represent, respectively, pixel brightness levels of pixels on a panel; operating a digital to analog conversion (DAC) circuit module that has preset DAC levels to convert the digital pixel signals into analog pixel signals at respective DAC levels; applying the analog pixel signals to cause illumination of individual pixels on the panel based on respective DAC levels of the pixels; and selecting at least one pixel on the panel to operate the pixel at, at least, a first DAC level in a first frame and at a second DAC level different from the first DAC level at a second frame subsequent to the first frame, to achieve a perceived brightness level for the pixel collectively produced by combining the first and second frames to be between a first brightness level corresponding to the first DAC level and a second brightness level corresponding to the second DAC level.

In another aspect, a device for producing light at different pixels on a panel is provided to include a panel; a digital controller that produces digital pixel signals that represent, respectively, pixel brightness levels of pixels on the panel; and a digital to analog conversion (DAC) circuit module configured to have preset DAC levels and coupled to the digital controller to receive the digital pixel signals. The DAC circuit module is operable to convert the digital pixel signals into analog pixel signals at respective DAC levels. The light producing module is provided to receive the analog pixel signals and to cause illumination of individual pixels on the panel based on respective DAC levels of the pixels. This device also includes a control mechanism that selects at least one pixel on the panel to operate the pixel at, at least, a first DAC level in a first frame and a second DAC level different from the first DAC level at a second frame subsequent to the first frame, to achieve a perceived brightness level for the pixel collectively produced by combining the first and second frames to be between a first brightness level corresponding to the first DAC level and a second brightness level corresponding to the second DAC level.

In yet another aspect, a technique is provided for controlling brightness of pixels on a panel is provided. This technique includes providing digital pixel signals that represent, respectively, pixel brightness levels of pixels on a panel; operating a digital to analog conversion (DAC) circuit module that has preset DAC levels to convert the digital pixel signals into analog pixel signals at respective DAC levels; applying the analog pixel signals to cause illumination of individual pixels on the panel based on respective DAC levels of the pixels; and controlling a block of a predetermined size of adjacent pixels on the panel to selectively operate one or more pixels in the block at a first DAC level and one or more other pixels in the block at a second DAC level different from the first DAC level to achieve a perceived average brightness level for the block between a first brightness level corresponding to the first DAC level and a second brightness level corresponding to the second DAC level.

In some implementations of the above technique, the first and second DAC levels may be adjacent DAC levels; the first and second DAC levels may be separated by one or more DAC levels; the technique may include generating the digital pixel signals for two or more sequential frames to produce an averaged frame from the two or more sequential frames wherein the averaged frame includes one or more predetermined sized blocks of adjacent pixels on the panel to achieve a perceived average brightness level for each block between two brightness levels that correspond to the two different DAC levels; and the technique may include controlling the predetermined sized adjacent pixel blocks on the panel, in addition to selectively operating one or more pixels in the block at the first DAC level and one or more other pixels in the block at the second DAC level next to the first DAC level, further to selectively operate one or more pixels in the block at a third DAC level that is different from the first and second DAC levels to achieve a perceived average brightness level for the block between a maximum brightness and a minimum brightness level of the brightness levels respectively corresponding to the first, second and third DAC levels; the panel may include an array of light sources that are energized by the analog pixel signals, one light source per analog pixel signal, to emit light.

In additional implementations of the above technique, the panel may include a fluorescent layer that absorbs an excitation light at a single excitation wavelength and emits visible light and includes a plurality of parallel fluorescent stripes elongated along a first direction and spaced from one another along a second direction perpendicular to the first direction, and the technique may further include applying the analog pixel signals to operate diode lasers to produce laser excitation beams of the excitation light of laser pulses at the single excitation wavelength and scanning the laser excitation beams along the second direction over the panel at different and adjacent screen positions along the first direction to produce different scan lines along the second direction, respectively, to cause the fluorescent layer of the panel to emit light in response to the laser pulses hitting respective pixel positions to produce respective pixel brightness levels in each scan line along the second direction. At least three adjacent fluorescent stripes may be made of three different fluorescent materials: a first fluorescent material that absorbs the excitation light and emits light of a first color, a second fluorescent material that absorbs the excitation light and emits light of a second color, and a third fluorescent material that absorbs the excitation light and emits light of a third color.

The above technique may also be implemented by configuring the panel to transmit or reflect received light without producing light of its own by applying the analog pixel signals to operate one or more laser to produce laser light of laser pulses. The laser light can be scanned on the panel to deliver the laser pulses at respective pixel positions on the panel to produce respective pixel brightness levels.

These and other aspects, their implementations, and associated examples are described in detail in the drawings, the detailed description and the claims.

DETAILED DESCRIPTION

The brightness control described in this document can be used in various panels or screens with pixels for display or illumination applications. Some of the display or illumination applications disclosed in this document use a panel or screen with pixilated structures or pixels that are physically formed on the panel or screen, such as panels with arrays of light sources such as a light-emitting-diode (LED) array or an organic LED array formed of LED pixels. In such a pixilated panel, the individual pixels are operated, e.g., by electrically energizing the light sources on the panel to emit light at desired optical brightness levels. Other display or illumination applications disclosed in this document can use panels or screens without any pixilated structures, such as some of the laser scanning beam displays described in this document where pixels formed on a panel or screen is formed by scanning laser light with laser pulses to deliver the laser pulses at respective pixel positions on the screen so that image pixels are visible on the panel or screen without physical pixel structures built on the panel or screen. Yet other display or illumination applications disclosed in this document can use panels or screens with some physical structures such as light-emitting regions used in some of the laser scanning beam displays described in this document where pixels formed on a panel or screen is formed by a combination of the presence of the light-emitting regions and the scanning of laser light with laser pulses to deliver the laser pulses at respective pixel positions on the screen.

Figure 1:
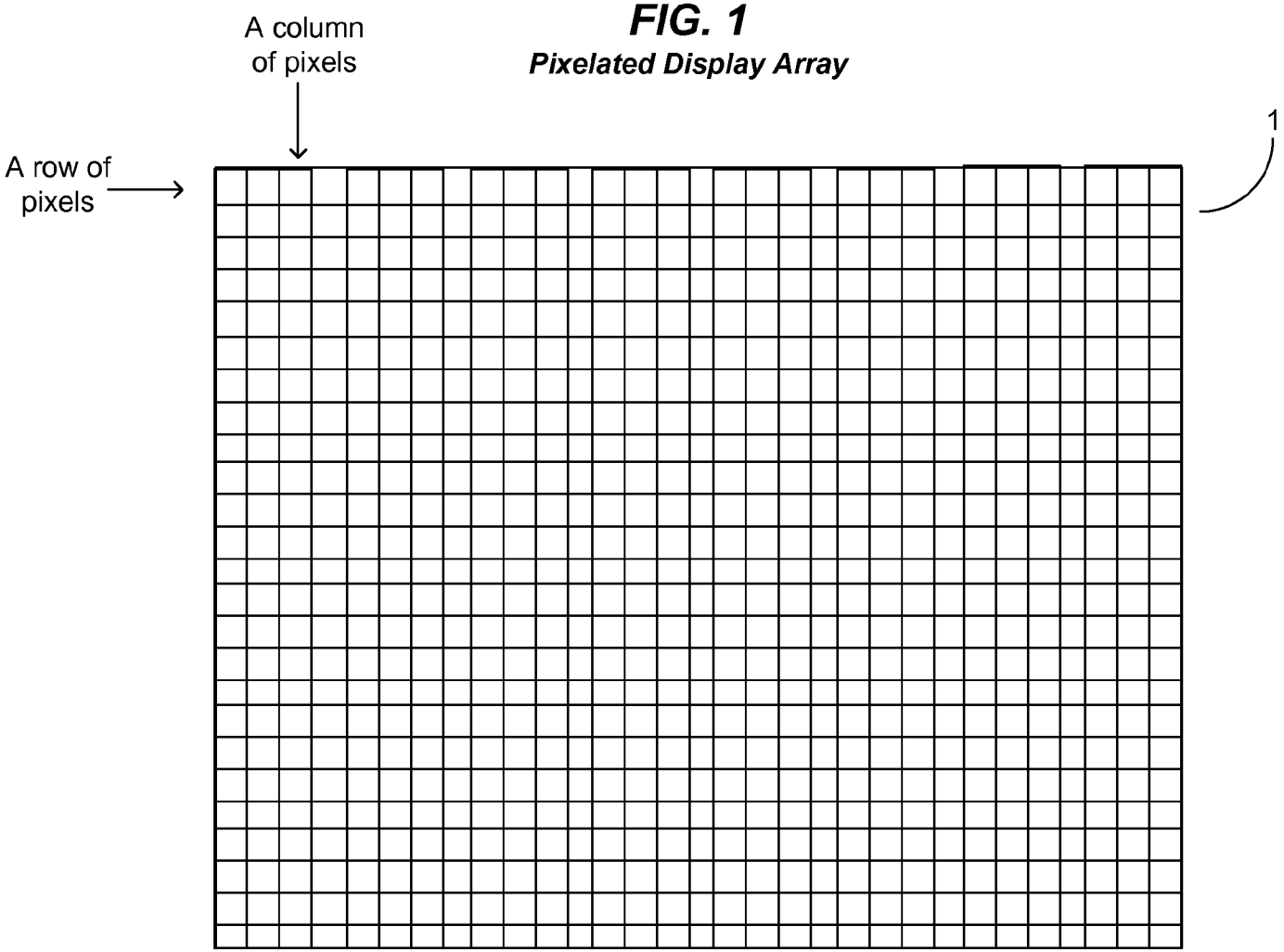
FIG. 1 shows an example of a panel that can produce pixilated images at respective pixel positions.

FIG. 1 shows an example of a panel 1 that can produce pixilated images at respective pixel positions based on any of the above mentioned designs. In this example, the pixels are arranged in rows and columns but in general the pixels can be arranged in other configurations. The brightness level of each pixel can be individually controlled.

Figure 2:
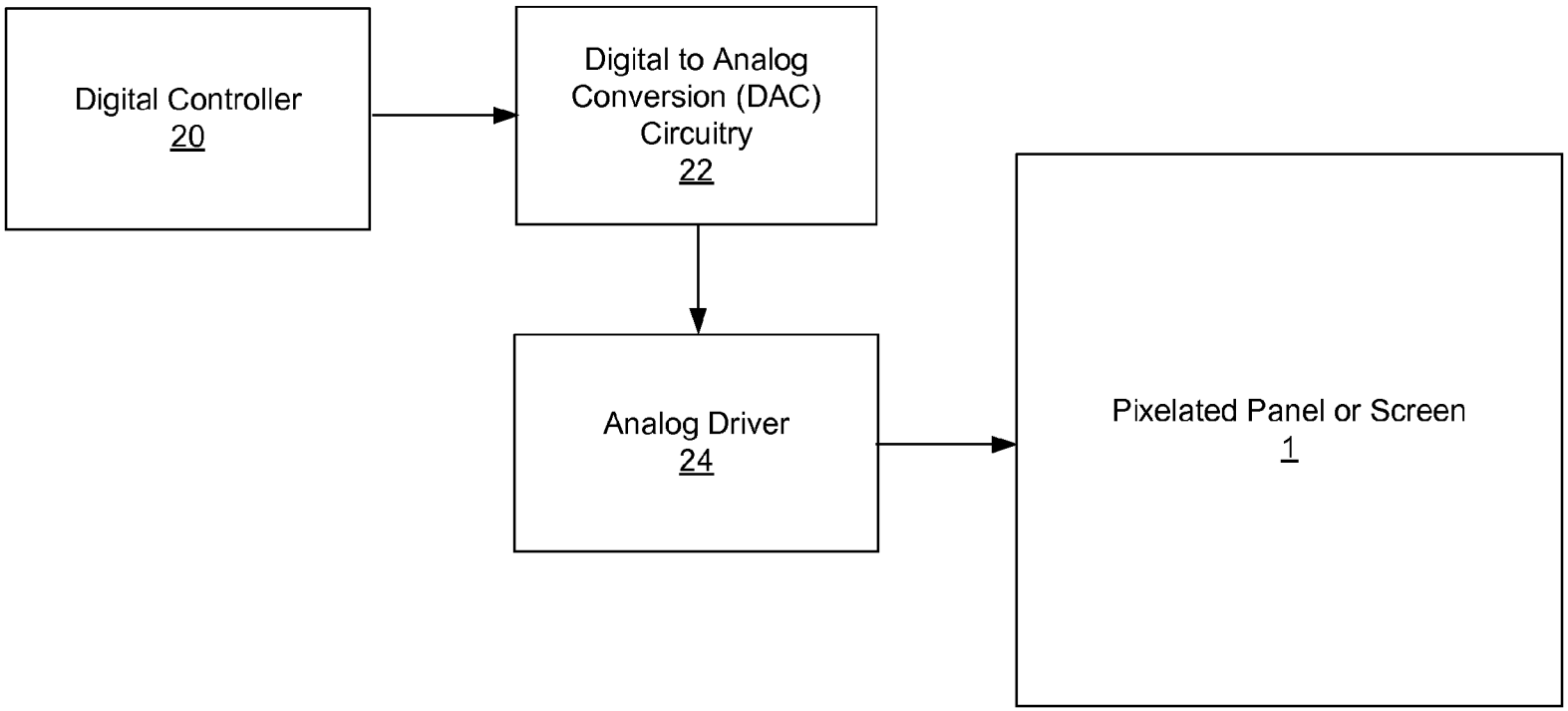
FIG. 2 shows a control circuit that operates the panel in FIG. 1.

Referring to FIG. 2, a device described in this document uses a digital controller 20 to produce digital pixel signals that represent, respectively, pixel brightness levels of pixels on the panel or screen 1 as shown in FIG. 1. A digital to analog conversion (DAC) circuit module 22 is designed or configured to have a preset DAC resolution between two adjacent DAC levels. This DAC 22 is coupled to the digital controller 20 to receive the digital pixel signals and to convert the received digital pixel signals into analog pixel signals at respective DAC levels. An analog driver 24 is then used, e.g., as part of a light producing module, to receive the analog pixel signals, and to cause illumination of individual pixels on the panel 1 based on respective DAC levels of the pixels. This driver 24 can be the driver for the LED or OLED array and may be integrated as part of the panel 1, or the driver for energizing one or more lasers in a laser scanning beam display described in this document and thus may be part of an optical module that is separated from the panel 1.

The DAC circuit module 22 has a preset DAC resolution between two adjacent DAC levels. Hence, each individual pixel on the panel 1 can only be at a pixel brightness level that is dictated by a respective DAC level and cannot be at a level between the two adjacent brightness levels associated with respective two adjacent DAC levels. This limitation caused by the DAC resolution can be problematic in certain applications where a pixel brightness level between two adjacent brightness levels associated with respective two adjacent DAC levels is needed. One example for this situation is in a lighting application where a panel is required to produce certain fine level of gray scales in illumination that are between the normal brightness levels determined by the DAC levels. Another example for this situation is a display device that needs to produce finer grey scales for showing texture of images at low brightness than grey scales at high brightness. Yet another example is matching brightness of different lasers in a device based on multiple lasers where two different lasers that have different discrete DAC level steps. Assume the laser No. 1, when operated under a DAC value of 50, produces a light level of 100 and under a DAC value of 51 produces a light level of 200 and another laser No. 2 under a DAC value of 49 produces a light value of 75, and under a DAC value of 50 produces a light level of 125, and under a DAC value of 51 produces a light level of 175. It is difficult to match the brightness of these two lasers using standard DAC steps but it is possible to operate the two lasers at some DAC levels between their standard discrete DAC levels to match the brightness of the two lasers, e.g., operating the laser No. 1 at the DAC level of 50 over 3 of 4 frames and at the DAC level of 51 over 1 of 4 frames to get a light value of 125 to match the brightness of the laser No. 2 operated at the DAC level of 50.

Figure 3A:
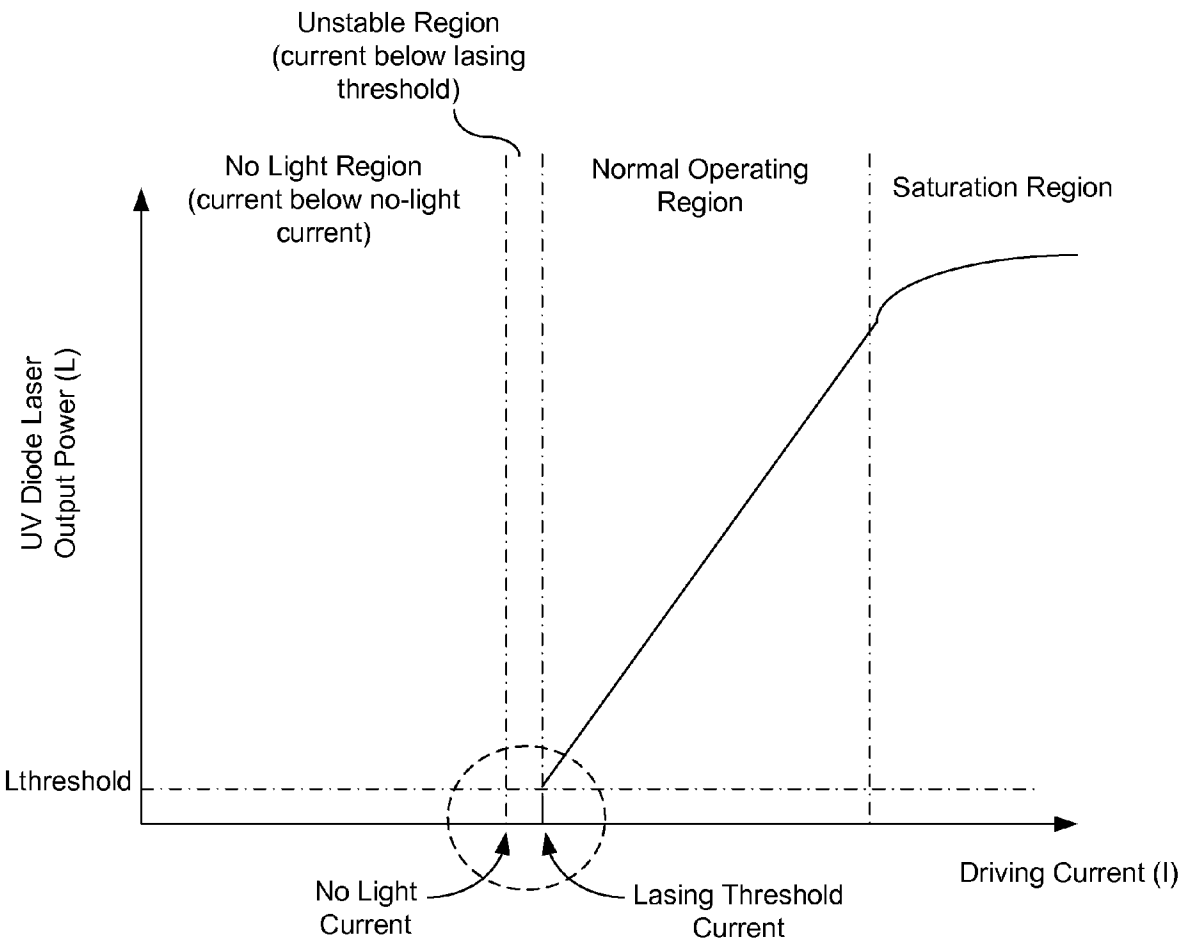
FIGS. 3A and 3B illustrate the optical output of a diode laser with respect to the laser driving current.
Figure 3B:
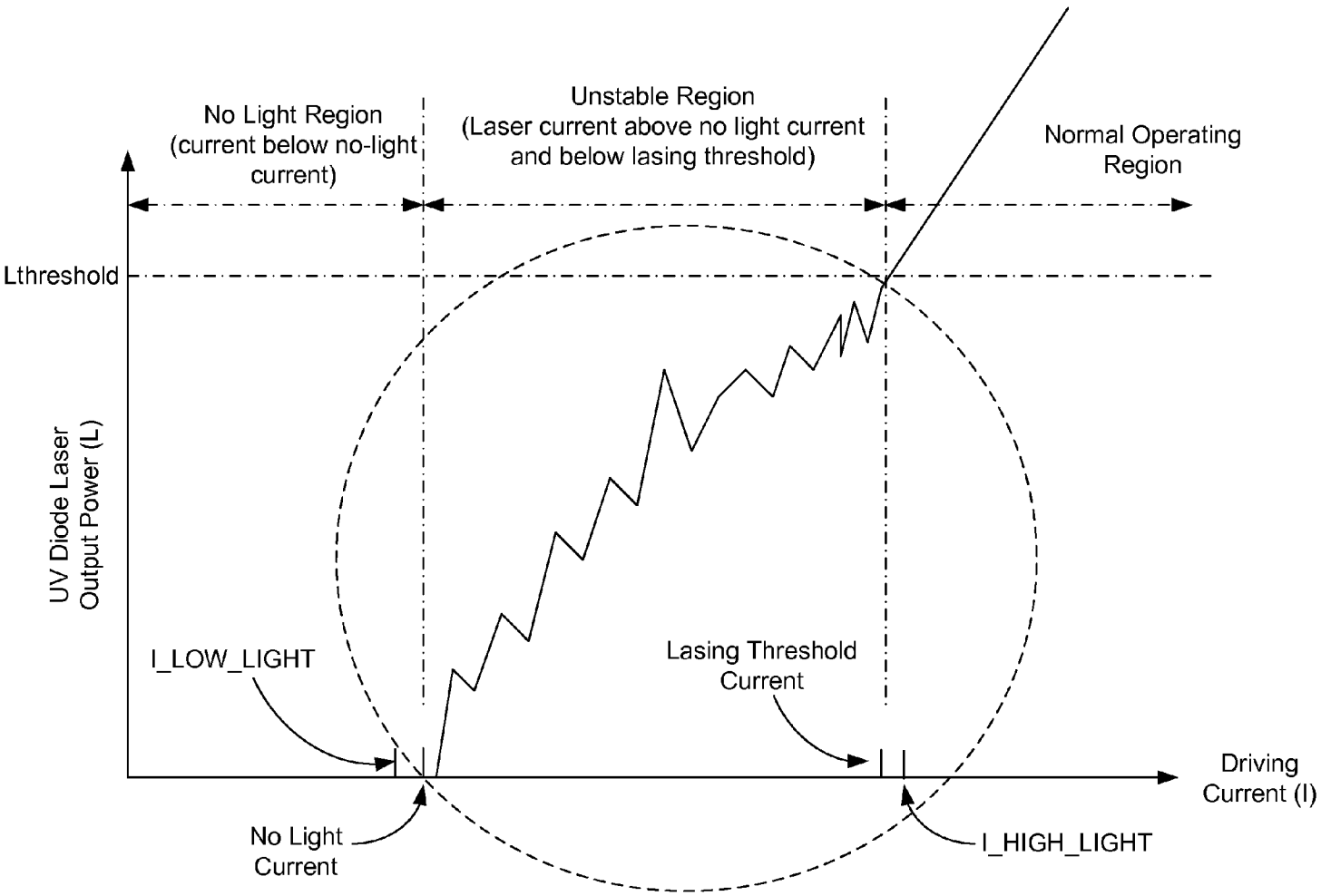

For certain light sources suitable for devices (e.g., FIGS. 6, 7A, 7B and 8) described in this document, the light output may become unstable when operated in an unstable condition, e.g., at a certain low light level. For example, the optical output of a diode laser as a light source tends to fluctuate when the diode laser driving current is below its normal lasing threshold current. FIGS. 3A and 3B illustrate this feature of a diode laser. FIG. 3A shows four regions of the diode laser: the no-light region where the diode laser does not emit light when the diode laser driving current is small or shut off, the unstable region where the diode laser driving current is below the threshold current and above the upper current limit in the no-light region, the normal operating region where the diode laser driving current is above the threshold current, and the saturation region where the diode laser driving current is very high that saturates the gain of the diode laser. In certain applications, such as some scanning beam displays using diode lasers disclosed in this document, is operated at or near the laser threshold current or even below the laser threshold current in order to achieve a certain low brightness level. Such an operating condition for a diode laser can lead to the unstable laser operation with undesired fluctuated laser output which can be visible to a viewer in an image display and the visibility of this fluctuation can be pronounced at a low light level condition.

The brightness control described in this document can be implemented in panels or screens with pixels for display or illumination applications to produce, at each pixel or within a block of adjacent pixels on the panel or screen, a perceived brightness level different from a brightness level that directly corresponds to a default DAC level of the DAC circuitry 22 in FIG. 2. In devices where the illumination of each individual pixel has an unstable brightness region to produce unstable illumination, the DAC circuit module can be operated to, when a pixel is to be dictated by a digital pixel signal to operate within a respective unstable brightness range, to control the pixel to operate at a DAC level below the unstable brightness range and at a different DAC level above the respective unstable brightness range, to achieve a perceived brightness level within the respective unstable brightness range without operating the pixel in the unstable brightness range.

More specifically, two or more multiple brightness levels can be generated for, a single pixel at different times or a block of adjacent pixels on the panel or screen, to be between two different brightness levels that correspond to two different DAC levels of the DAC circuitry 22. In some implementations of the present dithering techniques, pulsed energy can be applied to control and produce the brightness level at each pixel. The energy in each pulse can be controlled based on the pulse amplitude such as pulse amplitude modulation (PAM), a pulse code modulation (PCM) where the amplitude values of the pulse are digitized, the temporal duration of the pulse energy such as the pulse width modulation (PWM), or a combination of two or more such and other modulation methods. Hence, as a specific example, the pulse amplitude may be altered while keeping the pulse width as a constant to produce different levels of brightness in implementing the described dithering techniques.

Techniques for the brightness control described in this document can use temporal or spatial perception properties of human vision. It is well known that the temporal perception of human vision has vision persistence: the human vision retains perception of an image for a period of time after the image disappears or is changed into a different image. On average, an image persists for approximately one twenty-fifth of a second in human vision. This aspect of the temporal perception of human vision is analogous to the temporal integration of a signal at a pixel location or a block of adjacent pixels over time. In addition, human vision also performs spatial integration over a spatially extended region to reconstruct a more faithful representation of the region by reducing the noise. This spatial averaging reduces the spatial resolution of the reconstructed image. Referring to FIG. 1, this spatial averaging essentially treats a block of two or more adjacent pixels on the panel or screen 1 as a single effective and larger pixel.

Panels or screens with pixels for display or illumination applications shown in FIG. 1 operate by controlling the pixels to display a pattern or image one frame at a time and to display consecutive frames over time at a frame rate, e.g., 24 frames per second, 30 frames per second, 60 frames per second, 120 frames per second or 240 frames per second. Each frame is formed by controlled illumination of the pixels by various scanned illumination methods. For example, a frame can be constructed by a progressive scanning to illuminate pixels in one row at a time and sequentially scan through all rows. For another example, a frame can be constructed by an interlaced scanning to illuminate pixels in one row at a time and progressively scan through only odd-numbered rows at first and then progressively scan through only even-numbered rows. For yet another example, as illustrated in the example in FIG. 12, the analog driver 24 in FIG. 2 can illuminate, simultaneously, a block or segment of adjacent rows, and subsequently, simultaneously illuminate another adjacent block or segment of adjacent rows until all blocks or segments are illuminated to produce a frame.

Such a panel or screen can show a still pattern or image over a period when the pattern or image in each of the different frames displayed over the period are identical or substantially identical. Such a panel or screen can show a motion picture or video when the patterns or images in consecutive frames change.

One of techniques for achieving an appearance of finer brightness levels beyond the DAC-dictated brightness levels at the pixels on the panel 1 in FIG. 1 is to operate the device in FIG. 2 at a sufficiently high frame rate of M frames per second so that two or more consecutive frames, i.e., m consecutive frames, can be used to display an identical frame of a pattern or image. In this technique, the m consecutive frames are to display an identical frame of a pattern or image and the displayed pattern or image changes every other m frames so that the effective frame rate becomes (M/m) frames per second. The M and m numbers are configured so that the effective frame rate (M/m) is sufficient for a particular illumination or display application. For a display application, the (M/m) may be greater than 30 frames per second to produce an acceptable motion transition quality in the displayed motion picture. In this context, the consecutive m frames for displaying the same pattern or image are effectively subframes of a frame.

Notably, the m subframes for displaying the same pattern or image are controlled so that at least one pixel is operated under two or more different DAC levels to produce two or more different pixel brightness levels corresponding to the two or more DAC levels. The perceived pixel brightness of this pixel over the time of m subframes is the time-integrated result of the two or more different pixel brightness levels corresponding to the two or more DAC levels at this pixel location over the m subframes. Depending on selection of the two or more DAC levels for this pixel over the m subframes, the perceived pixel brightness of this pixel over the time of m subframes can be at one or more pixel brightness levels that are different from any one of default pixel brightness levels that correspond to default DAC levels. Therefore, for a given frame rate (M), the number of subframes, m, can be selected and, in addition, the default DAC levels can be selected for the m subframes, to collectively produce a desired time-integrated brightness level at that pixel that cannot be achieved by operating the pixel at any one of the default DAC levels. This time-integrated brightness level at that pixel is a dithered brightness level because it is generated by using two or more different default DAC levels via temporal integration and because it is between the default brightness levels. Multiple dithered brightness levels can be achieved at a given pixel. In implementations, a portion of pixels or all pixels on the panel or screen can be controlled based on this technique to produce desired dithered pixel brightness levels to meet the requirements of illumination or display applications.

Referring to FIG. 2, the above technique can be implemented in the digital controller 20 by generating desired digital pixel signals for a particular pixel over the m subframes. The digital controller 20 is configured to provide digital pixel signals that represent, respectively, pixel brightness levels of pixels on the panel. The digital controller 20 controls the particular pixel to operate, at least, a first DAC level in a first frame and a second DAC level different from the first DAC level at a second frame subsequent to the first frame to achieve a perceived brightness level for the pixel collectively produced by combining the first and second frames to be between a first brightness level corresponding to the first DAC level and a second brightness level corresponding to the second DAC level. The analog driver 24 in FIG. 2 applies analog pixel signals to cause illumination of individual pixels on the panel based on respective DAC levels of the pixels. In this technique, spatial integration of adjacent pixels is not performed and each pixel on the panel or screen is operated on its own to construct the displayed image or motion picture. Therefore, the original resolution of the panel or screen is preserved in the final displayed pattern or image. The brightness levels for a given pixel that is integrated over two or more subframes can be at two or more different default DAC levels that may or may not be adjacent DAC levels.

As a specific example for implementing this technique, consider a device based on FIG. 2 operating at a frame rate of M at 240 frames per second or 240 Hz. The number of subframes m can be set at 4 so the effective frame rate based on the above temporal integration over 4 frames is 60 frames per second or 60 Hz, which is above the threshold where human vision can detect the variation in pixel brightness.

As another example, referring back to the diode laser operation shown in FIGS. 3A and 3B, when a diode laser is used to produce light that is projected onto a pixel of the panel 1 to be at a low light level, the diode laser can be operated at a low DAC level driving current that is the lowest DAC level current above the diode laser threshold current to produce a low but stable or determinable laser output and is operated at higher DAC level currents for higher laser output. When a desired pixel brightness level corresponds to a level below the brightness of the lowest DAC level current above the diode laser threshold current, the diode laser is operated at a low current level in the unstable light-emitting region, without shutting down the diode laser, to produce either light at a very low power or essentially no output light, i.e., a "virtual black" pixel. Referring to FIG. 3B, due to the unstable region of a diode laser, the diode laser should be operated either at the normal operating region when the driving current is above the lasing threshold current or in the no-light region when the driving current is set at some current just below the highest no-light current below the unstable region. For a pixel brightness level that corresponds to a brightness level below the pixel brightness level when the diode laser is operated at the lasing threshold current, dithering is applied to operate the diode laser either in the no-light region or the normal operating region to achieve a perceived brightness level that corresponds to a brightness level that would be in the unstable region (below the pixel brightness level when the diode laser is operated at the lasing threshold current) without operating the diode laser in the unstable region. Diode lasers typically exhibit a delay (e.g., tens of nanoseconds in some diode lasers) in emitting light when the initial current is set at zero and the current is switched onto a value above the lasing threshold current. This delay can be significantly reduced to become essentially negligible if the initial current is biased at a current value above zero and below the highest current in the no-light region, e.g., I_LOW_LIGHT which corresponds to one of the DAC levels of DAC for a black level. For a current above the lasing threshold current, the diode laser can be operated at one of the currents corresponding to DAC levels of the DAC for the diode laser. As an example, assuming I_HIGH_LIGHT is the lowest current above the lasing threshold current that corresponds to a DAC level, the diode laser can be operated between I_LOW_LIGHT and I_HIGH_LIGHT to achieve a perceived brightness level that corresponds to a brightness level that would be in the unstable region (below the pixel brightness level when the diode laser is operated at the lasing threshold current) without operating the diode laser in the unstable region.

To achieve a low brightness level between the black level and the lowest brightness level corresponding to the lowest DAC level current above the diode laser threshold current, a pixel can be controlled by operating a diode laser that illuminates the pixel to produce a black pixel at one frame and operating the same diode laser or another diode laser that illustrates the same pixel at the next frame at a brightness level corresponding to a DAC level current above the diode laser threshold current, e.g., the lowest brightness level corresponding to the lowest DAC level current above the diode laser threshold current. The temporal integration of these two different pixel brightness levels at the same pixel over two or more subframes can achieve a perceived pixel brightness level at the pixel that is not obtainable by operating the diode laser at the DAC levels. In this example, the difference between the two DAC levels for the black and a pixel brightness for a DAC level above the diode laser threshold current can be, in some cases, two or more DAC levels.

Another technique for achieving dithered pixel brightness levels beyond the pixel brightness levels corresponding to default DAC levels is based on the spatial integration of human vision over a spatially extended region to reconstruct a more faithful representation of the region. Referring to FIG. 1, the panel can be operated to (1) control each individual pixel at a DAC-dictated brightness level and (2) control a block of adjacent pixels at different DAC levels to achieve a spatially averaged brightness level for the block of the adjacent pixels between discrete brightness levels corresponding to different DAC levels. This spatial block averaging produces an appearance of finer brightness levels beyond the DAC-dictated brightness levels at the pixels.

This technique can be implemented via a control mechanism that controls a block of a predetermined size of adjacent pixels on the panel to selectively operate one or more pixels in the block at a first DAC level and one or more other pixels in the block at a second DAC level different from the first DAC level to achieve a perceived average brightness level for the block between a first brightness level corresponding to the first DAC level and a second brightness level corresponding to the second DAC level. Depending a particular image or scene on the panel, this averaging of adjacent pixels can be performed at one or more selected areas of the panel or the whole panel and can be dynamically controlled by the digital controller 20 based on the image or scene to be produced on the panel 1.

Figure 4A:
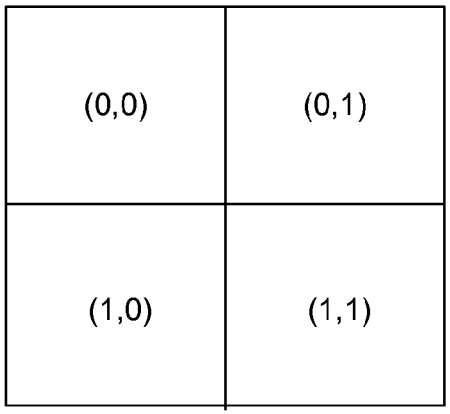
FIGS. 4A, 4B and 4C illustrate averaging techniques to achieve finer pixel brightness levels beyond the DAC levels.
Figure 4B:
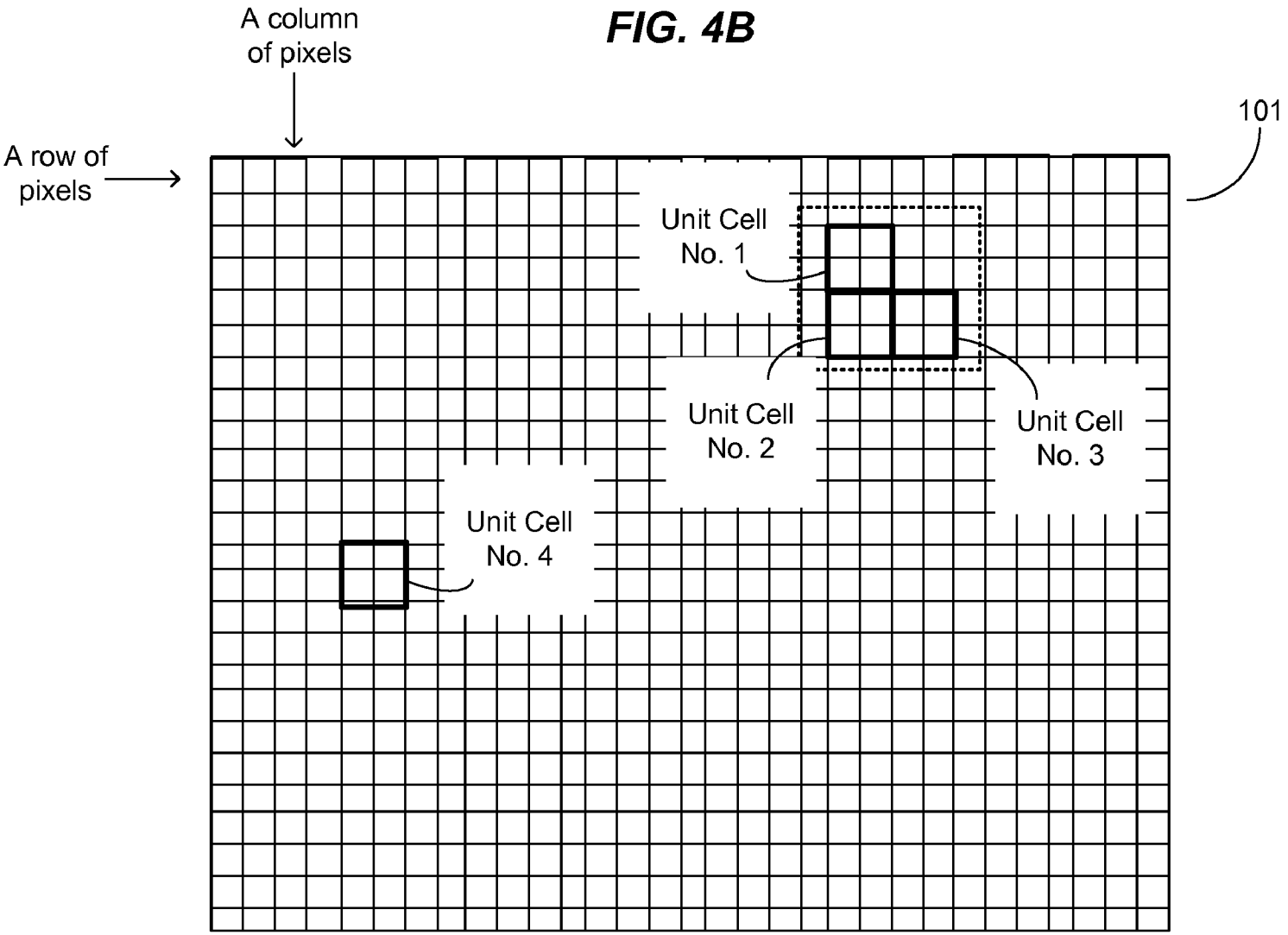
Figure 4C:
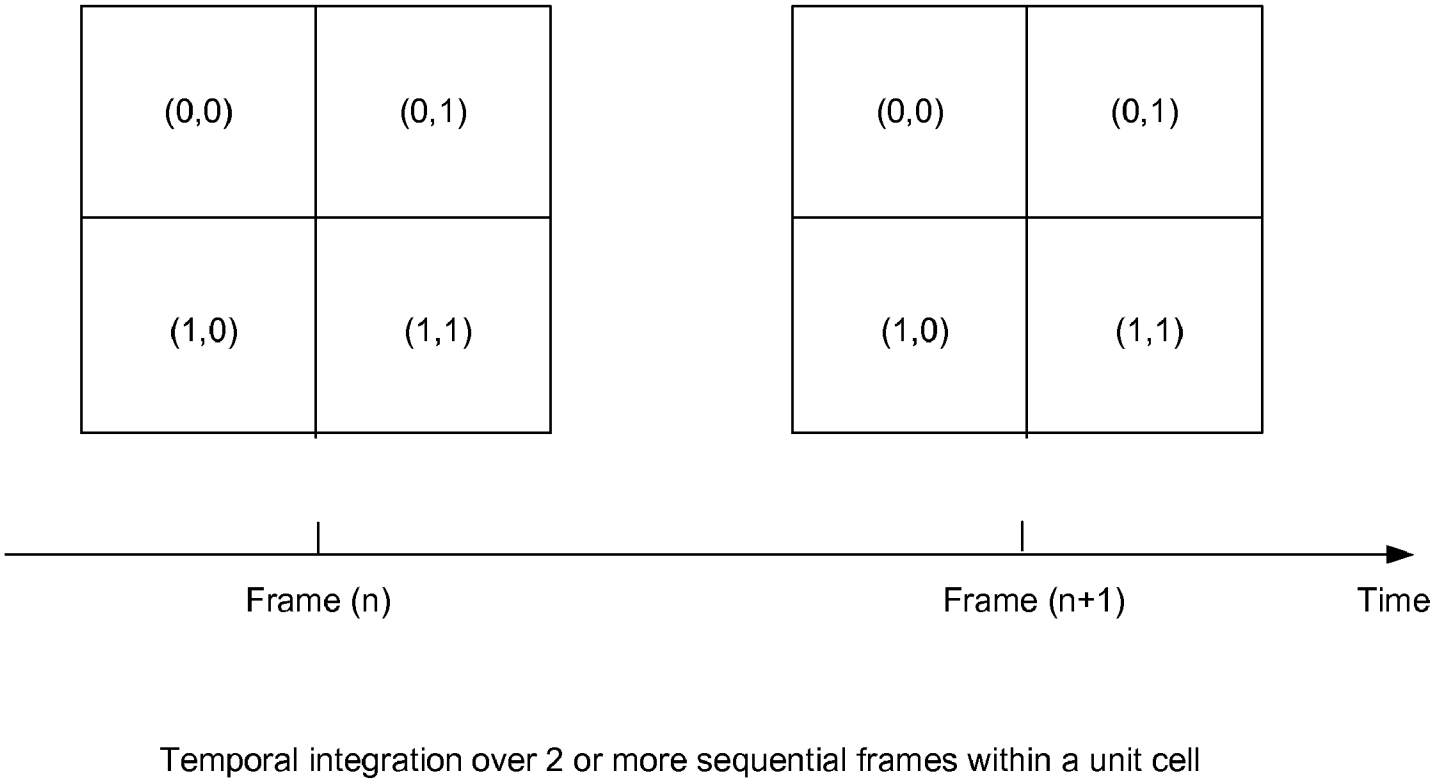

As an example, FIGS. 4A and 4B show an example which uses a 2 by 2 block of 4 adjacent pixels as a spatial averaging unit cell to achieve a brightness level between DAC-determined brightness levels for one or more unit cells. In FIG. 4A, four adjacent pixels form a square unit cell by 4 pixels at 4 position coordinates (0,0), (0,1), (1,0) and (1,1). Referring to FIG. 4B, in producing a particular scene on the panel 1, three adjacent unit cells 1-3 are shown in one region of the panel 1 to perform the spatial averaging and another unit cell 4 is shown at another region of the panel 1 to perform the spatial averaging. For some implementations, at least two pixels in each unit cell may be operated at two different DAC levels.

Referring back to the diode laser operation shown in FIGS. 3A and 3B, when a diode laser is used to produce light that is projected onto a pixel of the panel 1 to be at a low light level, the diode laser can be operated at a low DAC level driving current that is the lowest DAC level current above the diode laser threshold current to produce a low but stable laser output and is operated at higher DAC level currents for higher laser output. When a desired pixel brightness level corresponds to a level below the brightness of the lowest DAC level current above the diode laser threshold current, the diode laser is operated at a low current level below the unstable light-emitting region, without shutting down the diode laser, to produce either light at a very low power or essentially no output light, i.e., a "virtual black" pixel. To achieve a low brightness level between the black level and the lowest brightness level corresponding to the lowest DAC level current above the diode laser threshold current, the spatial averaging in one or more unit cells is performed by operating at least one diode laser to produce a black pixel and the same diode laser or another diode laser to produce, at another pixel adjacent to the black pixel, the lowest brightness level corresponding to the lowest DAC level current above the diode laser threshold current.

In implementations, three or more different DAC levels can be used to perform the averaging within each unit cell and the applied DAC levels may or may not adjacent DAC levels. For example, in addition to selectively operating one or more pixels in the unit cell in FIG. 4A at the first DAC level and one or more other pixels in the unit cell in FIG. 4A at the second DAC level different from the first DAC level, one or more pixels in the same unit cell can be operated at a third DAC level that is different from the first and second DAC levels to achieve a perceived average brightness level for the block between a maximum brightness and a minimum brightness level of the brightness levels respectively corresponding to the first, second and third DAC levels.

The above spatial averaging within a unit cell can be coupled with the temporal integration of a pixel brightness over different frames or subframes. This additional integration in time can be used to produce an averaged frame of the two or more sequential or consecutive frames which includes one or more unit cells on the panel to achieve a perceived average brightness level for each unit cell between two brightness levels that correspond to the two different DAC levels. Each of the two or more sequential frames can have different DAC level arrangement for the pixels in the unit cell. This combination of the using a spatial averaging unit cell of adjacent pixels with each operated at two or more DAC levels and temporal integration for each unit cell over two or more sequential frames produce a large number of dithered pixel brightness levels per unit cell beyond the pixel brightness levels solely based on the default DAC levels.

For example, consider the unit cell in FIG. 4A of 4 pixels each operated at two adjacent DAC levels, a "LOW_LIGHT" DAC level and a "HIGH_LIGHT" DAC level as shown in FIG. 3B. The spatial averaging of the unit cell has 3 additional different averaged levels between the "LOW_LIGHT" DAC level and a "HIGH_LIGHT" DAC level. The temporal averaging over two or more sequential frames further increases the number of averaged brightness levels for each unit cell.

Table 1 below lists various averaged levels for the 4-pixel unit cell in FIG. 4A when 4 sequential frames are averaged or dithered by operating the pixels in the unit cell at either the LOW_LIGHT DAC level (which can be a black level 0) or the HIGH_LIGHT DAC level (which can be a level of 32 that is above the diode laser threshold). There are 16 combinations or samples where a pixel value is either LOW_LIGHT or HIGH_LIGHT and each pattern or distribution of the DAC levels in the different adjacent 4 pixels within the unit cell is a dither pattern. In operation, the digital controller is operated to average 4 sequential frames and, for every pixel based on its location and current frame counter, a dither pattern is applied and the respective DAC levels for the dither pattern are applied to produce the respective pixel brightness based on their DAC levels.

TABLE 1

| Pixel Location | Frame | Dither Level | | | | | | | | | | | | | | | |
|---|---|---|---|---|---|---|---|---|---|---|---|---|---|---|---|---|---|
| (2 × 2 Unit Cell) | Count | 15 | 14 | 13 | 12 | 11 | 10 | 9 | 8 | 7 | 6 | 5 | 4 | 3 | 2 | 1 | 0 |
| (0, 0) | 0 | 1 | 1 | 1 | 1 | 1 | 1 | 1 | 1 | 1 | 1 | 1 | 1 | 1 | 1 | 1 | 0 |
| (0, 0) | 1 | 1 | 1 | 1 | 1 | 1 | 1 | 1 | 0 | 0 | 0 | 0 | 0 | 0 | 0 | 0 | 0 |
| (0, 0) | 2 | 1 | 1 | 1 | 1 | 1 | 1 | 1 | 1 | 1 | 1 | 1 | 0 | 0 | 0 | 0 | 0 |
| (0, 0) | 3 | 1 | 1 | 1 | 0 | 0 | 0 | 0 | 0 | 0 | 0 | 0 | 0 | 0 | 0 | 0 | 0 |
| (1, 0) | 0 | 1 | 0 | 0 | 0 | 0 | 0 | 0 | 0 | 0 | 0 | 0 | 0 | 0 | 0 | 0 | 0 |
| (1, 0) | 1 | 1 | 1 | 1 | 1 | 1 | 1 | 1 | 1 | 1 | 1 | 1 | 1 | 1 | 0 | 0 | 0 |
| (1, 0) | 2 | 1 | 1 | 1 | 1 | 1 | 0 | 0 | 0 | 0 | 0 | 0 | 0 | 0 | 0 | 0 | 0 |
| (1, 0) | 3 | 1 | 1 | 1 | 1 | 1 | 1 | 1 | 1 | 1 | 0 | 0 | 0 | 0 | 0 | 0 | 0 |
| (0, 1) | 0 | 1 | 1 | 1 | 1 | 0 | 0 | 0 | 0 | 0 | 0 | 0 | 0 | 0 | 0 | 0 | 0 |
| (0, 1) | 1 | 1 | 1 | 1 | 1 | 1 | 1 | 1 | 1 | 0 | 0 | 0 | 0 | 0 | 0 | 0 | 0 |
| (0, 1) | 2 | 0 | 0 | 0 | 0 | 0 | 0 | 0 | 0 | 0 | 0 | 0 | 0 | 0 | 0 | 0 | 0 |
| (0, 1) | 3 | 1 | 1 | 1 | 1 | 1 | 1 | 1 | 1 | 1 | 1 | 1 | 1 | 0 | 0 | 0 | 0 |
| (1, 1) | 0 | 1 | 1 | 1 | 1 | 1 | 1 | 1 | 1 | 1 | 1 | 0 | 0 | 0 | 0 | 0 | 0 |
| (1, 1) | 1 | 1 | 1 | 0 | 0 | 0 | 0 | 0 | 0 | 0 | 0 | 0 | 0 | 0 | 0 | 0 | 0 |
| (1, 1) | 2 | 1 | 1 | 1 | 1 | 1 | 1 | 1 | 1 | 1 | 1 | 1 | 1 | 1 | 1 | 0 | 0 |
| (1, 1) | 3 | 1 | 1 | 1 | 1 | 1 | 1 | 0 | 0 | 0 | 0 | 0 | 0 | 0 | 0 | 0 | 0 |

The 16 dithered pixel brightness levels in the above example can also be achieved by other implementations. For example, in stead of using the above unit cell of 4 adjacent spatial pixels for spatial averaging and the temporal integration over 4 consecutive frames, a block of 2 adjacent spatial pixels can be used to form a unit cell for spatial averaging and 8 temporal frames can be used for the temporal integration. As yet another example, 16 temporal frames can be integrated for each pixel without spatial averaging over two or more adjacent pixels to achieve 16 dithered pixel brightness levels based on temporal dithering only with a highest spatial resolution.

Figure 5A:
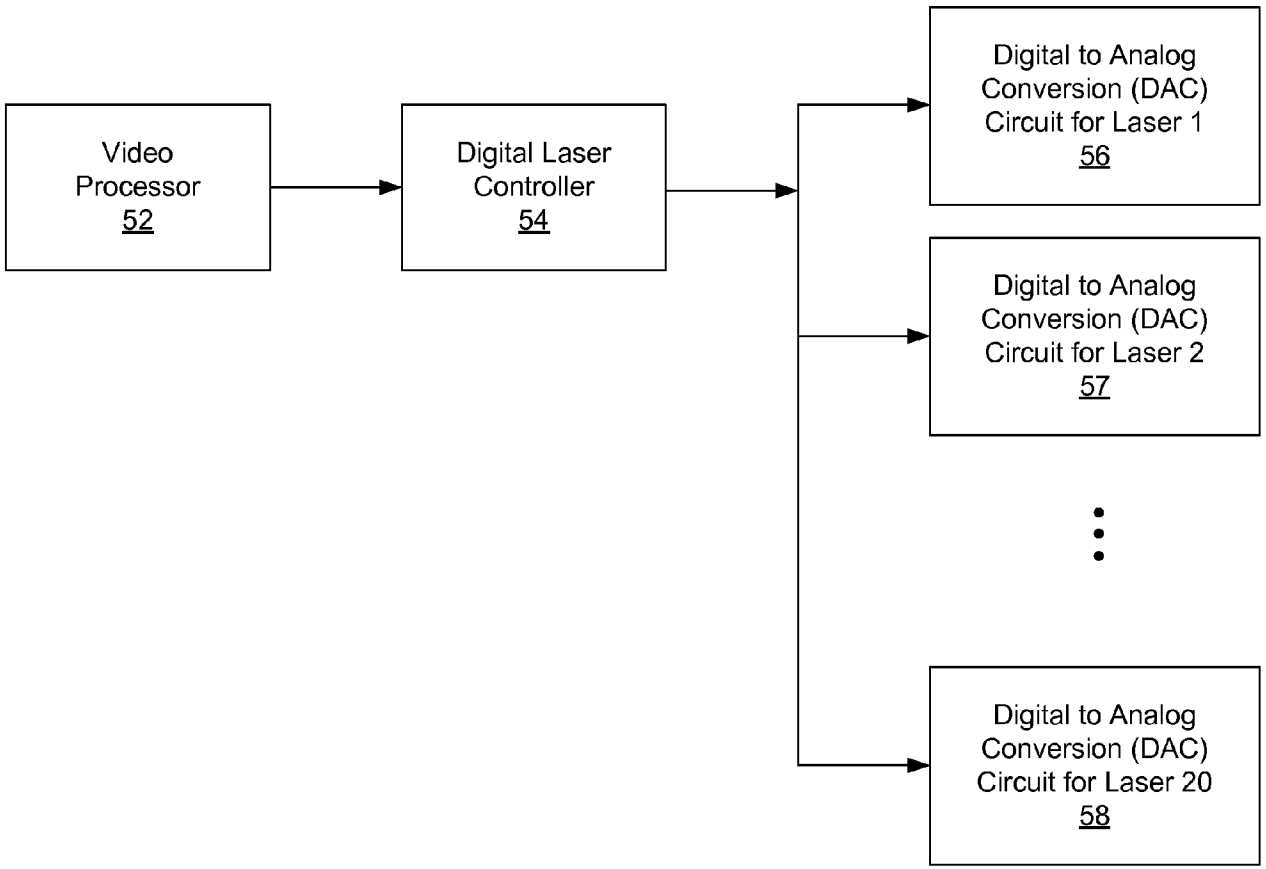
FIG. 5A shows one example of a laser display that uses a digital controller to provide dithering based on spatial averaging or temporal integration.

FIG. 5A illustrates an example of a laser display where multiple diode lasers are operated to produce multiple laser beams (e.g., 20 diode lasers) to simultaneously illuminate different pixel positions on a screen. This laser display includes a video processor 52 that produces digital pixel signals and a digital laser controller 54 that produces desired digital signals based on either or both spatial averaging and temporal integration for the DAC circuits 56, 57 and 58 that respectively drive the diode lasers, one DAC circuit per diode laser. In some implementations, the digital laser controller 54 may include a field-programmable gate array (FPGA) that is programmable based on either or both spatial averaging and temporal integration to produce the digital pixel signals for the DAC circuits 56, 57 and 58. For temporal integration operation, a frame counter value is stored for each of the subframes for every image frame. Once an image frame is displayed, the frame count is incremented. For example, the frame counter may have 4 subframes is incremented through the frame count of 0, 1, 2 and 3 to produce the following sequence [0,1,2,3,0,1,2,3,0 . . . ] when a particular image frame is displayed.

The dithering by the digital laser controller 54 can produce an effective DAC resolution higher than the actual DAC resolution of the DAC circuits 56, 57 and 58 for the lasers, e.g., 16-bit DAC values can be achieved by using the dithering example in Table 1 for 8-bit DAC circuits 56, 57 and 58. The dither level can be calculated by ("Higher precision value"−MIN_DAC)/(MAX_DAC−MIN_DAC). This dithering by the digital laser controller 54 can also be used to achieve low light gray levels at pixels between a high light level of a diode laser operated at a DAC level above the laser threshold and a low light level (e.g., a back level without laser output). The dithering between the HIGH_DAC which is mapped to HIGH_LIGHT value (e.g., 16) and LOW_DAC which is mapped to LOW_LIGHT value (e.g., 0) can be calculated as ("required light value"−LOW_LIGHT)/(HIGH_LIGHT−LOW_LIGHT). For example, the required light value is 4 then dithering level is 25% (4 out of 16). When both spatial averaging and temporal integration are applied in dithering, each pixel is assigned a DAC value based on its pixel location in a unit cell (e.g., 2×2 block) and the frame counter of the subframes for the temporal integration for a desired dithering level. For example, if a dithering pattern yields 0 then LOW_DAC is used to drive the laser; and if dithering pattern yields 1, then HIGH_DAC is used to drive the laser.

In operation, the digital laser controller 54 in FIG. 5A receives digital pixel signals at a video frame rate from the video processor 52. The digital laser controller 54 compares each digital pixel signal to DAC levels to determine whether the desired brightness level in the received digital pixel signal matches the brightness level of a DAC level. If there is a match, no dithering is needed and the digital pixel signal is applied to the respective DAC which drives the respective diode laser at a default DAC output level. If there is no match, the digital laser controller 54 performs a dithering algorithm based on a frame count for temporal integration over successive subframes, a spatial dither pattern of each unit cell of adjacent pixels to perform spatial averaging per unit cell or a combination of both.

Figure 5B:
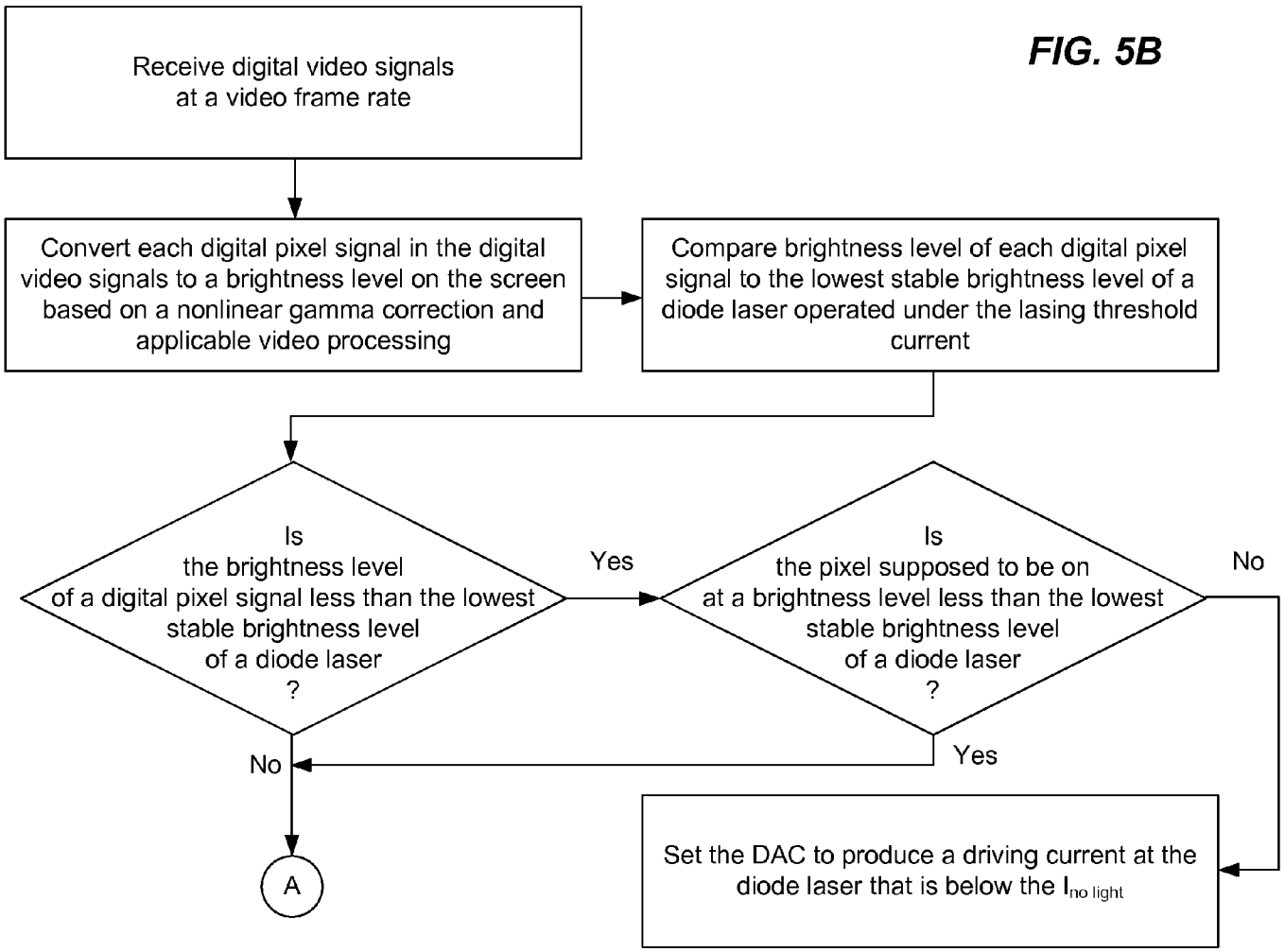
FIGS. 5B and 5C show an example of the processing steps by the digital controller in FIG. 5A.
Figure 5C:
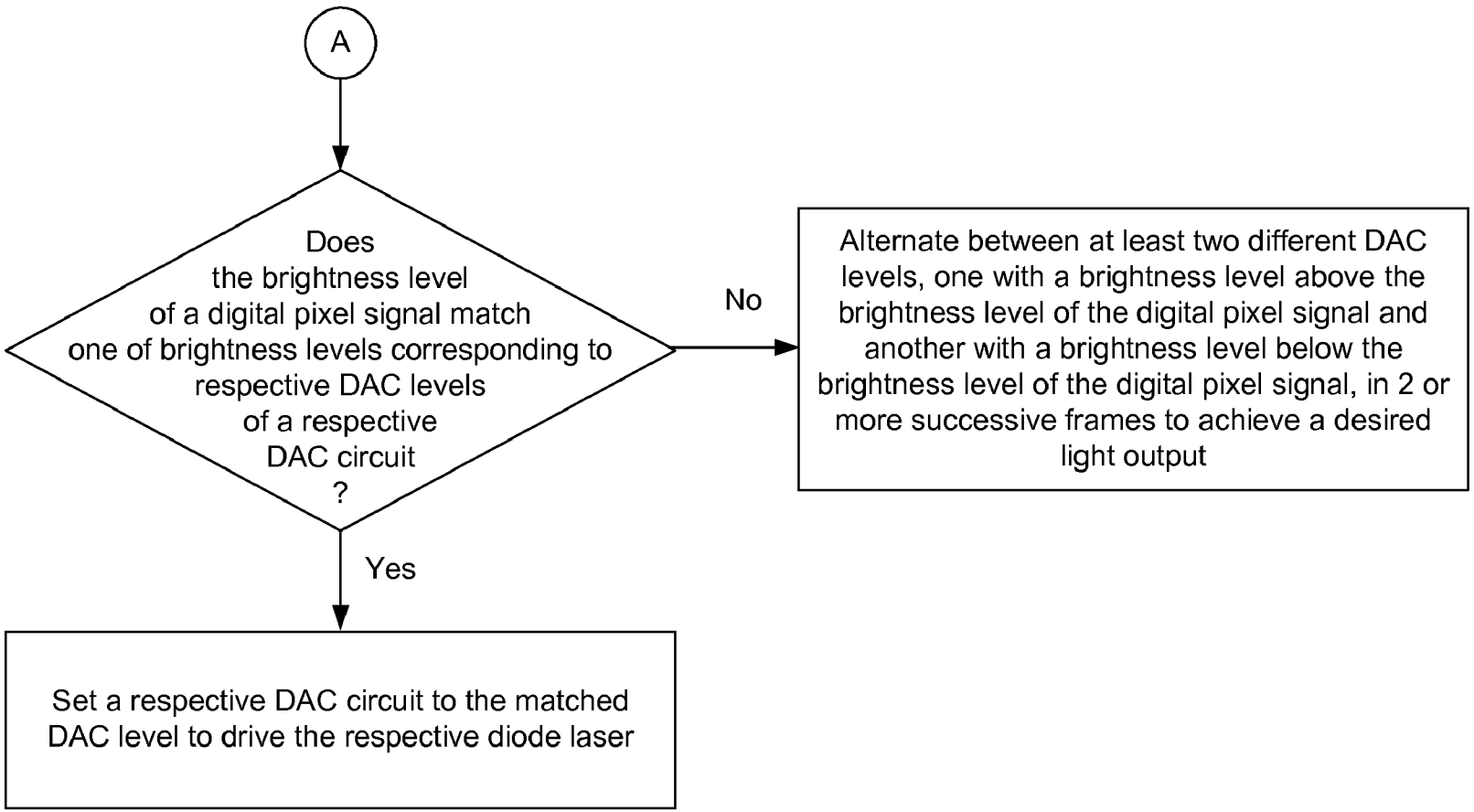

FIGS. 5B and 5C illustrate an example of the operation steps for the digital laser controller 54 in FIG. 5A to perform a dithering algorithm. In this example, the digital laser controller 54 first converts each digital pixel signal in the received digital video signals from the video processor 52 into a brightness level on the screen based on a nonlinear gamma correction and applicable video processing. The digital laser controller 54 then compares the brightness level of each digital pixel signal to the lowest stable brightness level of a diode laser operated under the lasing threshold current as shown in FIG. 3B. When the brightness level of a digital pixel signal is less than the lowest stable brightness level of a diode laser, the digital laser controller 54 can either perform dithering when the pixel is supposed to be on at a level that would otherwise fall within the brightness level of the unstable region of the diode laser or operate the diode laser at a bias current in the no-light region (i.e., turning the pixel off). If, on the other hand, the brightness level of a digital pixel signal is greater than the lowest stable brightness level of a diode laser, the digital laser controller 54 can either perform dithering when the pixel brightness level does not match one of the brightness levels corresponding to DAC levels of the DAC driving the diode laser, or operate the diode laser at a corresponding DAC level which matches the pixel brightness level. In dithering between two DAC levels both above the brightness level corresponding to the lasing threshold current, the digital laser controller 54 can alternate between at least two different DAC levels, one with a brightness level above the brightness level of the digital pixel signal and another with a brightness level below the brightness level of the digital pixel signal, in 2 or more successive frames to achieve a desired light output.

In implementing the exemplary operation control shown in FIGS. 5B and 5C, both unit cells for spatial dithering patterns and temporal integration over 2 or more subsequent subframes can be used to produce the desired dithering. Notably, the decision for dithering inside a block or unit cell of adjacent pixels may be independent of other pixels within the block or unit cell and may also be independent of other subframes.

For example, consider the block or unit cell of 4 adjacent pixels in FIG. 4A. Assume that Pixel (0,0) has a light value of 20, Pixel (0,1) has a light value of 40, Pixel (1,0) has a light value of 50, and Pixel (1,1) has a light value of 10. In addition, it is assumed that, based on the dither levels in Table 1, the Pixel (0,0) has a dither level 10, Pixel (0,1) and Pixel (1,0) are above the stable laser brightness level and are not dithered, and Pixel (1,1) has a dither level 5. The dithering can be implemented in Frame counts of 0, 1, 2 and 3 for 4 successive subframes as follows:

Frame Count=0:
Pixel (0,0) is set to light level 32.
Pixel (0,1) is set to light level 40.
Pixel (1,0) is set to light level 50.
Pixel (1,1) is set to light level 0.
Frame Count=1:
Pixel (0,0) is set to light level 32.
Pixel (0,1) is set to light level 40.
Pixel (1,0) is set to light level 50.
Pixel (1,1) is set to light level 0.
Frame Count=2:
Pixel (0,0) is set to light level 32.
Pixel (0,1) is set to light level 40.
Pixel (1,0) is set to light level 50.
Pixel (1,1) is set to light level 32.
Frame Count=3:
Pixel (0,0) is set to light level 0.
Pixel (0,1) is set to light level 40.
Pixel (1,0) is set to light level 50.
Pixel (1,1) is set to light level 0.

In the above example, the decision to dither each pixel within the block of 4 adjacent pixels is independent of all other pixels in the block. For the temporal integration over 4 successive, each pixel within the block follows the temporal pattern defined for that pixel location.

Figure 6:
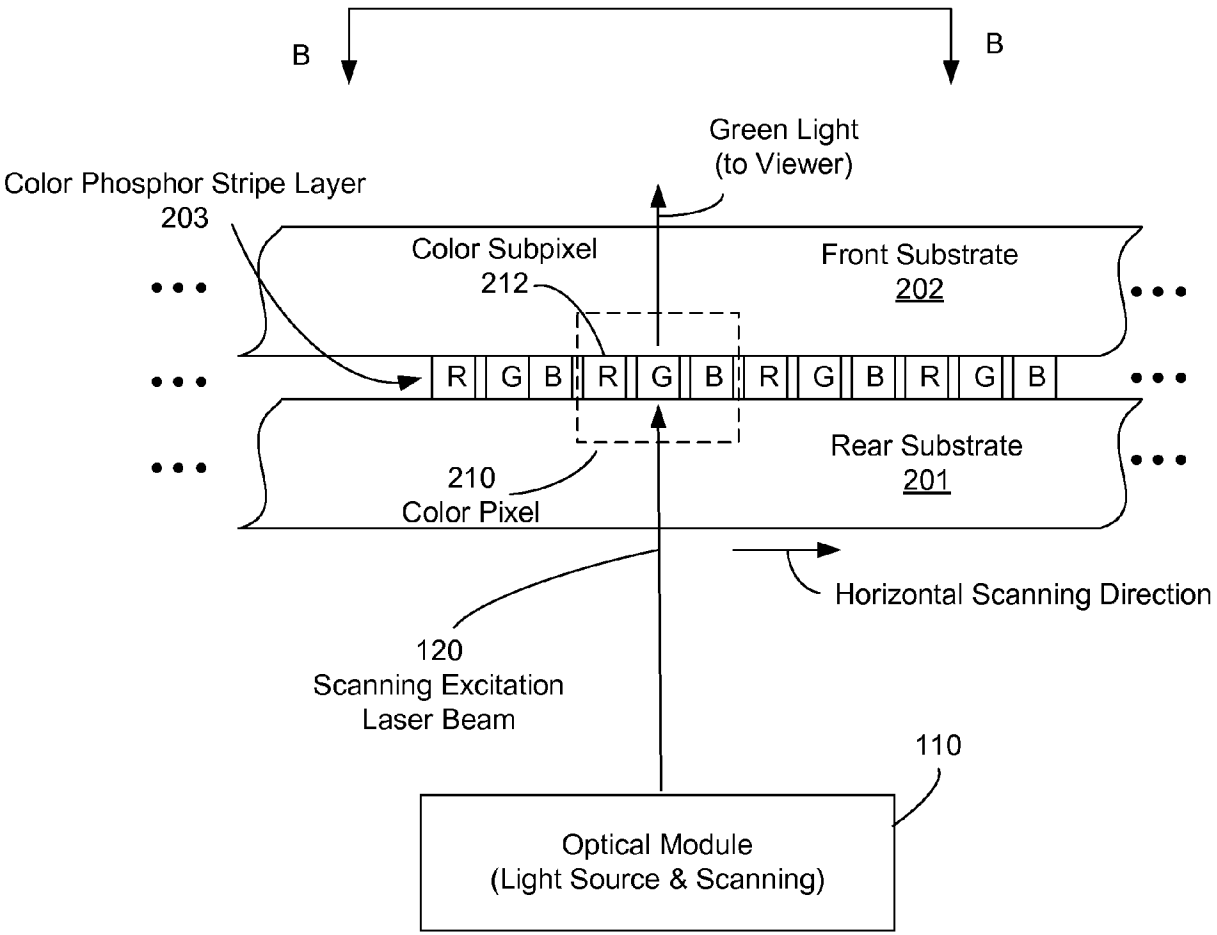
FIGS. 6, 7A, 7B and 8 show different implementations of the panel or screen in FIG. 1.
Figure 8:
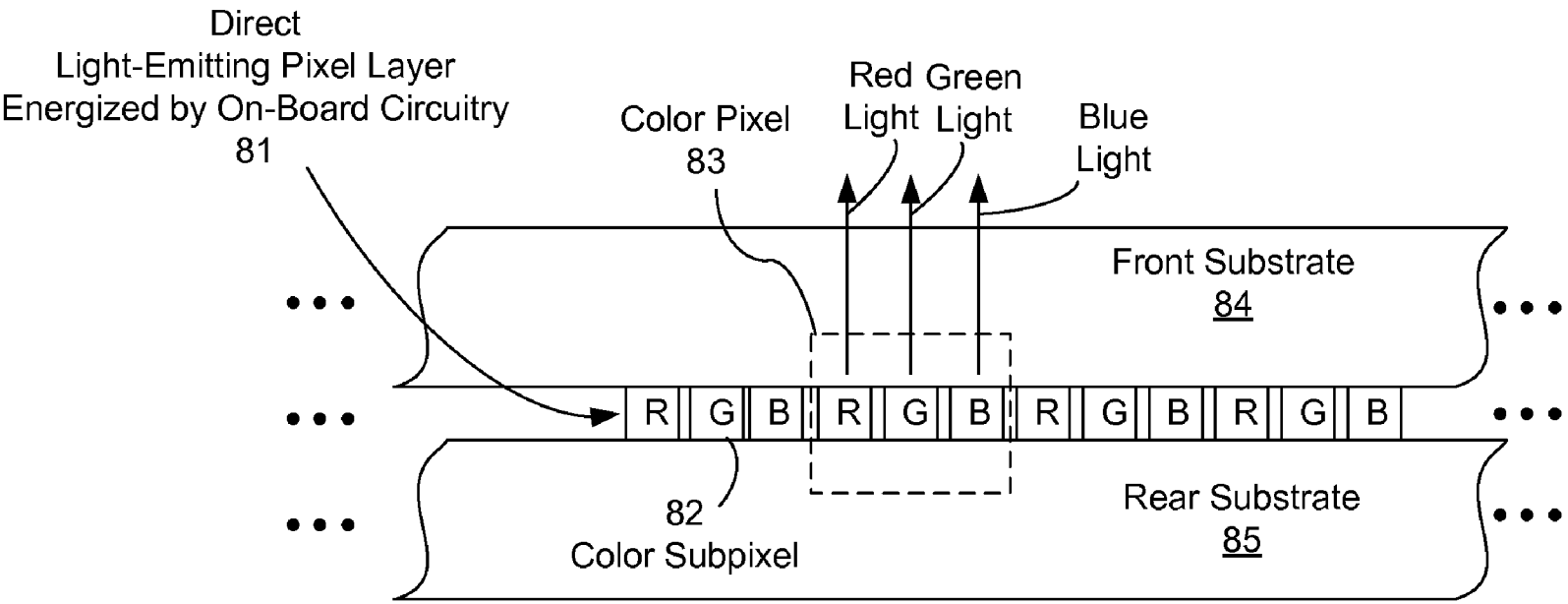

As illustrated in FIGS. 6 and 8 for two different color display systems where a color pixel is formed of three adjacent subpixels that respectively produce three different colors, e.g., red, green and blue colors, for the color pixel, the decision to dither can be based on sub-pixel light levels. For example, consider Pixel (0,0) to have a red light value of 50, green light value of 20 and blue light value of 10, and the red, green and blue dither levels are 0 (no dither), 10, 5, respectively. The dithering can be implemented based on the following dithering patterns for different subpixels within a color pixel (0,0):

Frame Count=0:
Red Subpixel (0,0)→50
Green Subpixel (0,0)→32
Blue Subpixel (0,0)→32
Frame Count=1:
Red Subpixel (0,0)→50
Green Subpixel (0,0)→32
Blue Subpixel (0,0)→0
Frame Count=2:
Red Subpixel (0,0)→50
Green Subpixel (0,0)→32
Blue Subpixel (0,0)→32
Frame Count=3:
Red Subpixel (0,0)→50
Green Subpixel (0,0)→0
Blue Subpixel (0,0)→0

The dithering inside a block by the digital laser controller can be independent of other frames. For example, if the brightness level for the pixel (0,0) in FIG. 4A changes with the frames, e.g., varies from 50, to 16, to 16 and to 26 for the frame count of 0, 1, 2 and 3, respectively, the dither may have the following dithering pattern corresponding to dither levels of 0, 8, 8 and 13 for the frame count of 0, 1, 2 and 3, respectively:

Frame Count=0→50;
Frame Count=1→0;
Frame Count=2→32; and
Frame Count=3→32.

The above operations for achieving finer pixel brightness levels beyond the DAC levels of the DAC in the device via temporal integration over two or more consecutive frames, spatial averaging over a block of adjacent pixels, or a combination of the temporal integration and spatial averaging can be used in various devices. FIGS. 6 through 8 show some specific examples of devices that can use the above dithering techniques.

FIG. 6 shows an exemplary design of the panel 1 that uses a light-emitting fluorescent layer with different light-emitting regions formed on the panel 1 that emit visible light by absorbing excitation light such as UV light. In this particular example, the light-emitting regions are parallel stripes and an optical module 110 is provided to scan laser excitation light 120 modulated with optical pulses through the stripes to produce pixilated images. The panel 1 includes a rear substrate 201 which is transparent to the scanning laser beam 120 and faces the laser module 110 to receive the scanning laser beam 120. A second front substrate 202 is fixed relative to the rear substrate 201 and faces the viewer in a rear projection configuration. A color phosphor stripe layer 203 is placed between the substrates 201 and 202 and includes phosphor stripes. The color phosphor stripes for emitting red, green and blue colors are represented by "R", "G" and "B," respectively. The front substrate 202 is transparent to the red, green and blue colors emitted by the phosphor stripes. The substrates 201 and 202 may be made of various materials, including glass or plastic panels. Each color pixel includes portions of three adjacent color phosphor stripes in the horizontal direction and its vertical dimension is defined by the beam spread of the laser beam 120 in the vertical direction. As such, each color pixel includes three subpixels of three different colors (e.g., the red, green and blue). The laser module 110 scans the laser beam 120 one horizontal line at a time, e.g., from left to right and from top to bottom to fill the panel 1. The laser module 110 is fixed in position relative to the panel 1 so that the scanning of the beam 120 can be controlled in a predetermined manner to ensure proper alignment between optical pulses in the laser beam 120 and each pixel position on the panel 1. As illustrated, the scanning laser beam 120 is directed at the green phosphor stripe within a pixel to produce green light for that pixel.

Figure 7A:
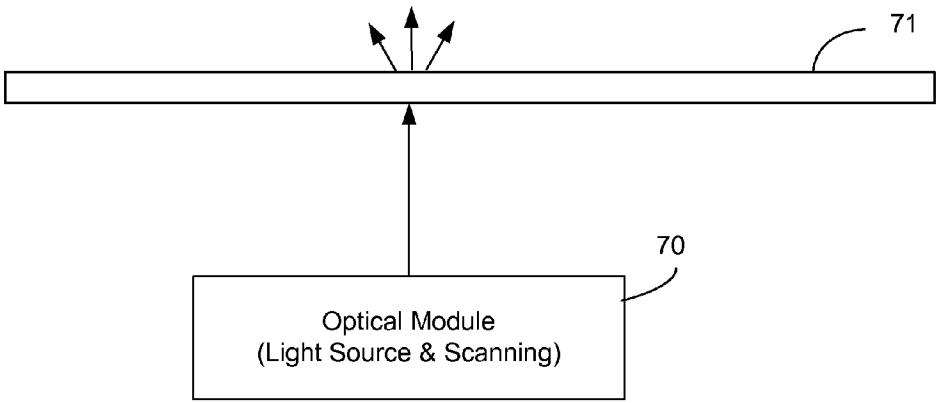
Figure 7B:
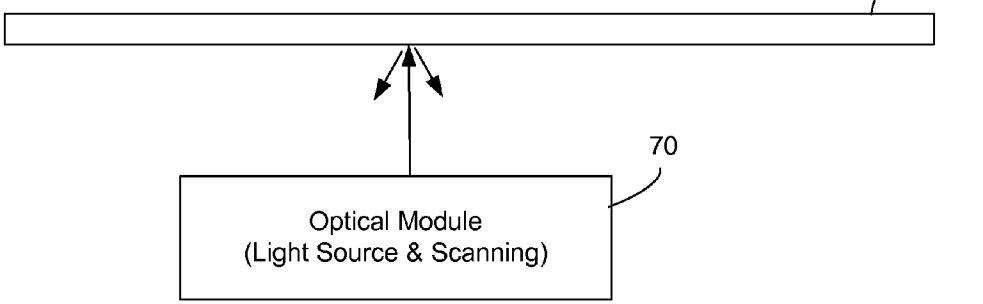

FIGS. 7A and 7B show two examples of display or illumination devices where the panel or screen is structured as an optically passive structure that transmits or reflects received light without producing light of its own. Such screens or planes do not have any pixilated structures and the optical module 70 produces visible laser light of laser pulses and scans the visible laser light onto the screen to deliver the laser pulses at respective pixel positions on the screen so that image pixels are visible on the panel or screen without physical pixel structures built on the panel or screen. In FIG. 7A, the screen 71 is formed of a transmissive material and forms a rear projection display to produce images on the other side of the screen. In FIG. 7B, the screen 72 is reflective so the images is viewed on the same side of the optical module 70. Such devices can use scanning red, green and blue laser beams that spatially overlap with one another to form a single beam spot on the screen 71 or 720 to generate different colors at each pixel position.

FIG. 8 shows a direct light-emitting panel or screen with built-in pixilated structures or pixels that are physically formed on the panel or screen. In this example, the panel 1 includes substrates 84 and 85 and a direct light-emitting pixel layer 81 with light-emitting pixels 82 between the substrates 84 and 85. Three adjacent pixels 82 can be different pixels that emit light of different colors such as red (R), green (G) and blue (B) and form a color pixel 83. A driver circuit can be integrated on broad in the panel 1 to drive the light-emitting pixels 82. Examples of light sources for the pixels 82 include light-emitting diodes (LEDs) or organic LEDs (OLEDs). In such a pixilated panel, the individual pixels are operated, e.g., by electrically energizing the light sources on the panel to emit light at desired optical brightness levels.

The above and other various panels are operated based on the same circuitry shown in FIG. 2 where the DAC 22 is used to convert the digital pixel signals into analog pixel signals for diving the individual pixels.

The following examples focus on scanning-beam display systems based on the above dithering technology using the configuration in FIG. 6, 7A or 7B. One or more optical beams are modulated to carry optical pulses in time domain over a screen in a raster scanning pattern to form images on a screen. Each scanning beam has a small beam footprint that is less than or equal to a subpixel on the screen and the beam footprint scans the sub-pixel and is modulated in optical power or intensity in the time domain to carry images. Raster scanning of such a modulated beam on the screen converts images carried by the sequential optical pulses into spatial patterns as images on the screen.

In some implementations of a scanning beam display system, the screen may be a passive screen that does not emit new light and directly uses the light of the one or more scanning optical beams to form the images by, e.g., reflecting, transmitting, diffusing or scattering the light of the one or more scanning optical beams. In a rear projection mode with red, blue and green beams carrying images respectively in red, green and blue colors, the passive screen receives the red, green and blue beams from one side and diffuses, transmits or scatters the received light to produce colored images for viewing on the other side of the screen.

In other implementations, the screen of such a display system is a light-emitting screen. Light-emitting materials are included in such a screen to absorb the light of the one or more scanning optical beams and to emit new light that forms the images. The light of the one or more scanning optical beams is not directly used in forming the images seen by a viewer. For example, the screen is a light-emitting screen that emits visible light in colors by converting excitation energy applied to the screen into the emitted visible light, e.g., via absorption of excitation light. The emitted visible light forms the images to a viewer. The screen can be implemented to include multiple screen layers, one or more of which have light-emitting components that convert the excitation energy into the emitted visible light that forms the images.

Scanning beam display systems based on light-emitting screens use screens with light-emitting materials such as fluorescent materials to emit light under optical excitation to produce images. A light-emitting screen can include a pattern of light-emitting regions that emit light for forming images and non-light-emitting regions that are filled in spaces between the light-emitting regions. The designs of the light-emitting regions and non-light-emitting regions can be in various configurations, e.g., one or more arrays of parallel light-emitting stripes, one or more arrays of isolated light-emitting island-like regions or pixel regions, or other design patterns. The geometries of the light-emitting regions can be various shapes and sizes, e.g., squares, rectangles or stripes. Examples described below use a light-emitting screen that has parallel light-emitting stripes separated by non-light-emitting lines located between the light-emitting stripes. Each light-emitting stripe can include a light-emitting material such as a phosphor-containing material that either forms a contiguous stripe line or is distributed in separated regions along the stripe.

In one implementation, for example, three different color phosphors that are optically excitable by the laser beam to respectively produce light in red, green, and blue colors suitable for forming color images may be formed on the screen as pixel dots or repetitive red, green and blue phosphor stripes in parallel. Various examples described in this application use screens with parallel color phosphor stripes for emitting light in red, green, and blue to illustrate various features of the laser-based displays. Phosphor materials are one type of fluorescent materials. Various described systems, devices and features in the examples that use phosphors as the fluorescent materials are applicable to displays with screens made of other optically excitable, light-emitting, non-phosphor fluorescent materials, such as quantum dot materials that emit light under proper optical excitation (semiconductor compounds such as, among others, CdSe and PbS).

Examples of scanning beam display systems described here use at least one scanning laser beam to excite color light-emitting materials deposited on a screen to produce color images. The scanning laser beam is modulated to carry images in red, green and blue colors or in other visible colors and is controlled in such a way that the laser beam excites the color light-emitting materials in red, green and blue colors with images in red, green and blue colors, respectively.

Hence, the scanning laser beam carries the images but does not directly produce the visible light seen by a viewer. Instead, the color light-emitting fluorescent materials on the screen absorb the energy of the scanning laser beam and emit visible light in red, green and blue or other colors to generate actual color images seen by the viewer.

Laser excitation of the fluorescent materials using one or more laser beams with energy sufficient to cause the fluorescent materials to emit light or to luminesce is one of various forms of optical excitation. In other implementations, the optical excitation may be generated by a non-laser light source that is sufficiently energetic to excite the fluorescent materials used in the screen. Examples of non-laser excitation light sources include various light-emitting diodes (LEDs), light lamps and other light sources that produce light at a wavelength or a spectral band to excite a fluorescent material that converts the light of a higher energy into light of lower energy in the visible range. The excitation optical beam that excites a fluorescent material on the screen can be at a frequency or in a spectral range that is higher in frequency than the frequency of the emitted visible light by the fluorescent material. Accordingly, the excitation optical beam may be in the violet spectral range and the ultra violet (UV) spectral range, e.g., wavelengths under 420 nm. In the examples described below, UV light or a UV laser beam is used as an example of the excitation light for a phosphor material or other fluorescent material and may be light at other wavelength.

Figure 9:
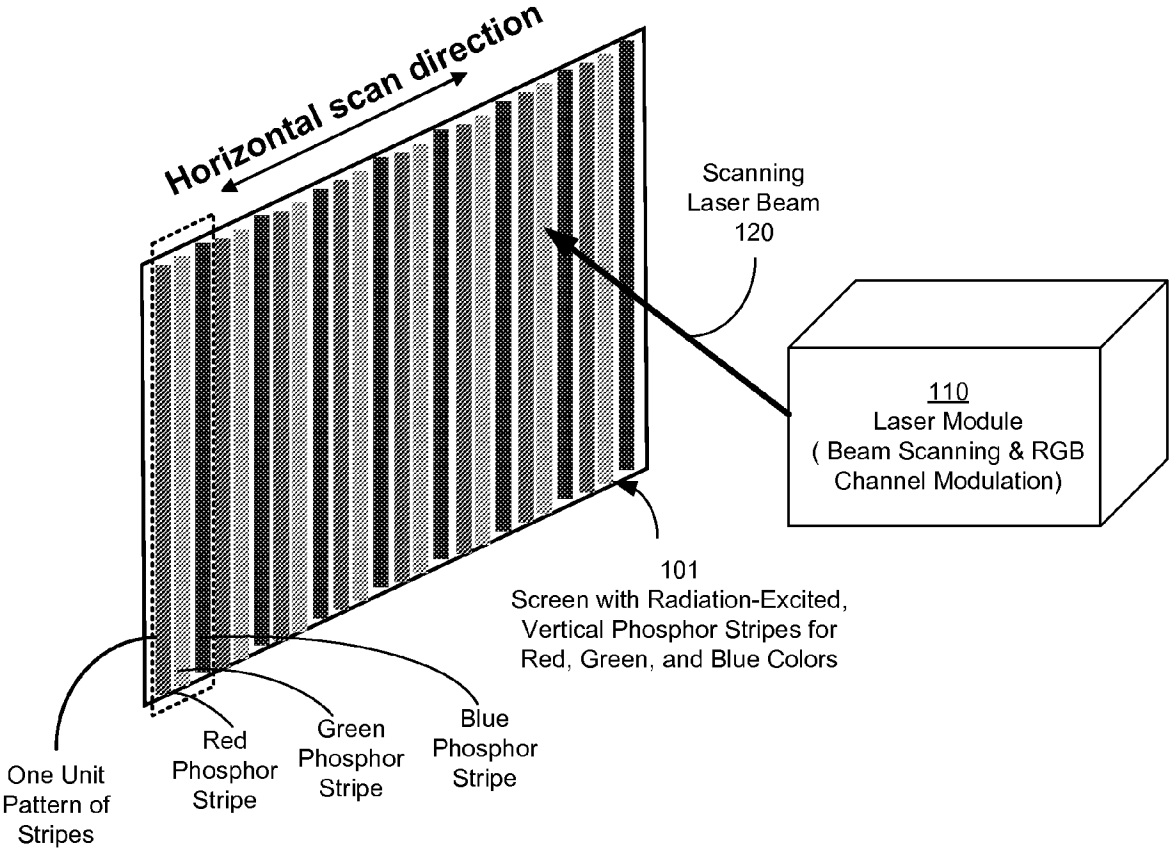
FIG. 9 shows an example scanning laser display system having a fluorescent screen made of laser-excitable phosphors emitting colored lights under excitation of a scanning laser beam that carries the image information to be displayed.

FIG. 9 illustrates an example of a laser-based display system using a screen having color phosphor stripes. Alternatively, color phosphor dots may also be used to define the image pixels on the screen. The system includes a laser module 110 to produce and project at least one scanning laser beam 120 onto a screen 101. The screen 101 has parallel color phosphor stripes in the vertical direction where red phosphor absorbs the laser light to emit light in red, green phosphor absorbs the laser light to emit light in green and blue phosphor absorbs the laser light to emit light in blue. Adjacent three color phosphor stripes are in three different colors. One particular spatial color sequence of the stripes is shown in FIG. 1 as red, green and blue. Other color sequences may also be used. The laser beam 120 is at the wavelength within the optical absorption bandwidth of the color phosphors and is usually at a wavelength shorter than the visible blue and the green and red colors for the color images. As an example, the color phosphors may be phosphors that absorb UV light in the spectral range from about 380 nm to about 420 nm to produce desired red, green and blue light. The laser module 110 can include one or more lasers such as UV diode lasers to produce the beam 120, a beam scanning mechanism to scan the beam 120 horizontally and vertically to render one image frame at a time on the screen 101, and a signal modulation mechanism to modulate the beam 120 to carry the information for image channels for red, green and blue colors. Such display systems may be configured as rear projection systems where the viewer and the laser module 110 are on the opposite sides of the screen 101. Alternatively, such display systems may be configured as front projection systems where the viewer and laser module 110 are on the same side of the screen 101.

FIG. 2A shows an exemplary design of the screen 101 in FIG. 1. The screen 101 may include a rear substrate 201 which is transparent to the scanning laser beam 120 and faces the laser module 110 to receive the scanning laser beam 120. A second front substrate 202, is fixed relative to the rear substrate 201 and faces the viewer in a rear projection configuration. A color phosphor stripe layer 203 is placed between the substrates 201 and 202 and includes phosphor stripes. The color phosphor stripes for emitting red, green and blue colors are represented by "R", "G" and "B," respectively. The front substrate 202 is transparent to the red, green and blue colors emitted by the phosphor stripes. The substrates 201 and 202 may be made of various materials, including glass or plastic panels. Each color pixel includes portions of three adjacent color phosphor stripes in the horizontal direction and its vertical dimension is defined by the beam spread of the laser beam 120 in the vertical direction. As such, each color pixel includes three subpixels of three different colors (e.g., the red, green and blue). The laser module 110 scans the laser beam 120 one horizontal line at a time, e.g., from left to right and from top to bottom to fill the screen 101. The laser module 110 is fixed in position relative to the screen 101 so that the scanning of the beam 120 can be controlled in a predetermined manner to ensure proper alignment between the laser beam 120 and each pixel position on the screen 101.

Figure 10:
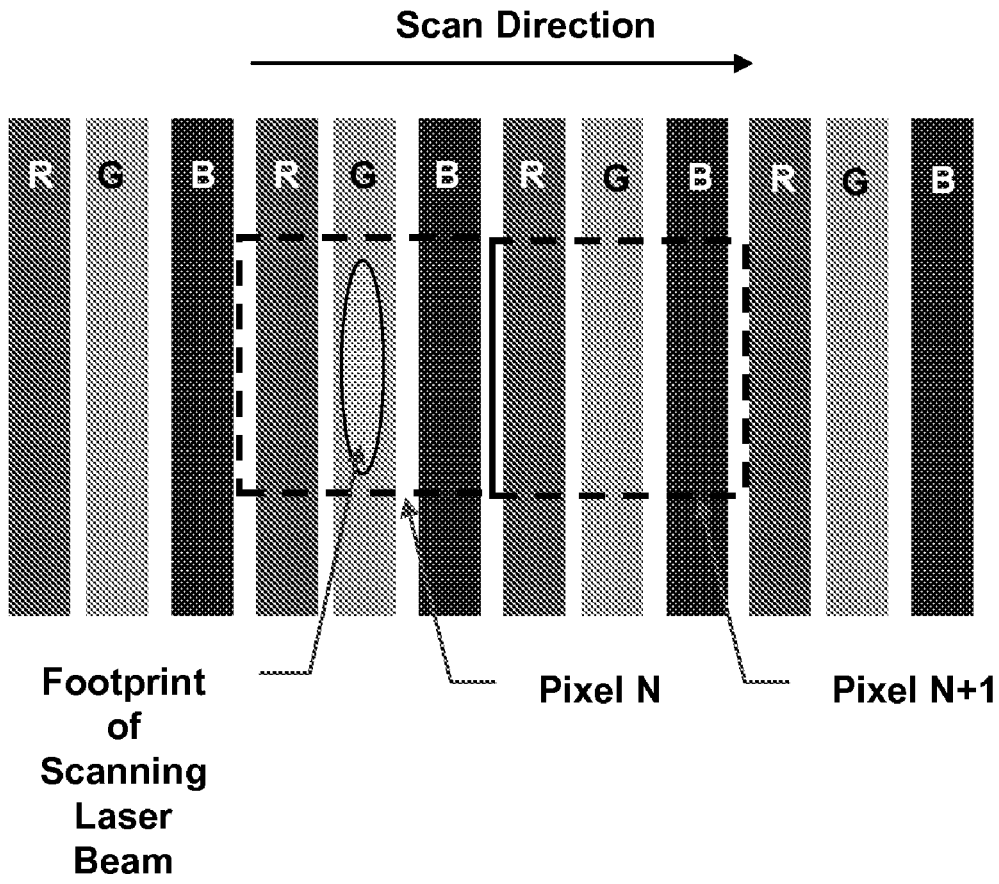
FIG. 10 shows one example of the structure of color pixels on the screen in FIG. 1 and FIG. 29.

The screen 101 can be constructed based on the design in FIG. 6. FIG. 10 further shows the operation of the screen 101 in a view along the direction B-B perpendicular to the surface of the screen in FIG. 6. Since each color stripe is longitudinal in shape, the cross section of the beam 120 may be shaped to be elongated along the direction of the stripe to maximize the fill factor of the beam within each color stripe for a pixel. This may be achieved by using a beam shaping optical element in the laser module 110. A laser source that is used to produce a scanning laser beam that excites a phosphor material on the screen may be a single mode laser or a multimode laser. The laser may also be a single mode along the direction perpendicular to the elongated direction phosphor stripes to have a small beam spread that is confined by the width of each phosphor stripe. Along the elongated direction of the phosphor stripes, this laser beam may have multiple modes to spread over a larger area than the beam spread in the direction across the phosphor stripe. This use of a laser beam with a single mode in one direction to have a small beam footprint on the screen and multiple modes in the perpendicular direction to have a larger footprint on the screen allows the beam to be shaped to fit the elongated color subpixel on the screen and to provide sufficient laser power in the beam via the multimodes to ensure sufficient brightness of the screen.

Figure 11A:
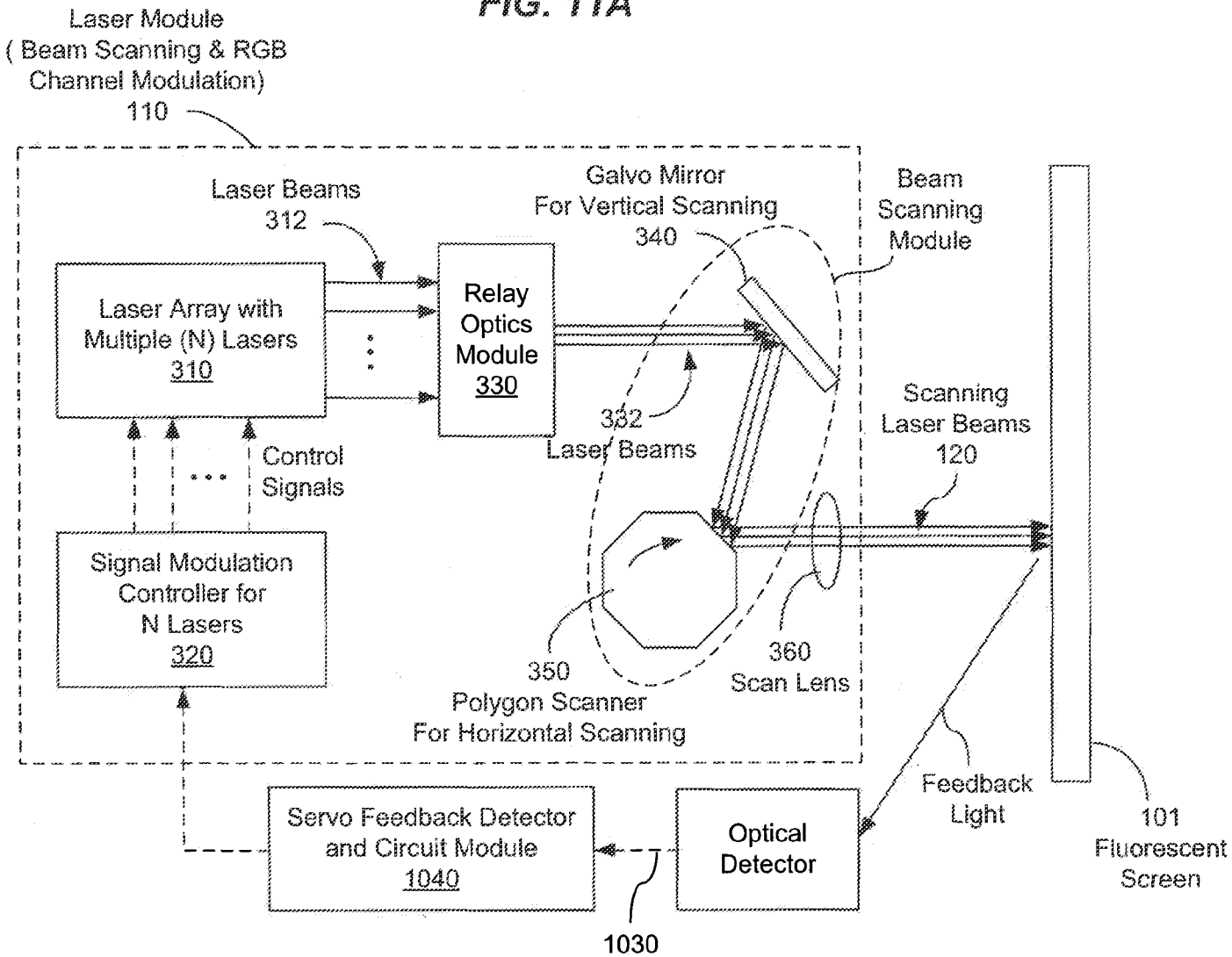
FIGS. 11A, 11B and 11C show exemplary implementations of the laser module in FIG. 9 having multiple lasers that direct multiple laser beams on the screen.
Figure 11B:
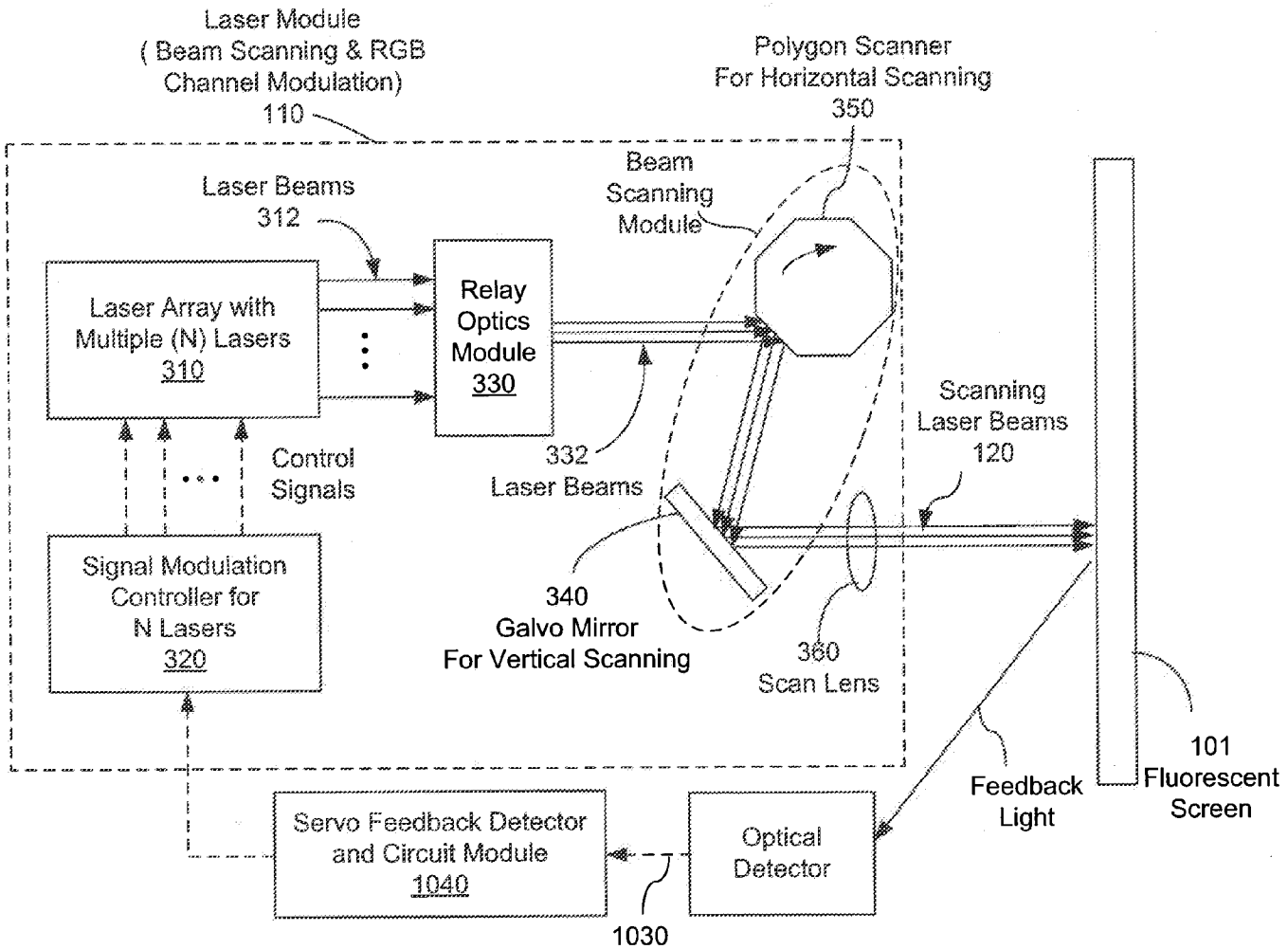

FIGS. 11A and 11B show two examples of the laser module 110 in FIG. 9. A laser array 310 with multiple lasers is used to generate multiple laser beams 312 to simultaneously scan the screen 101 for enhanced display brightness. The laser array 310 can be implemented in various configurations, such as discrete laser diodes on separate chips arranged in an array and a monolithic laser array chip having integrated laser diodes arranged in an array. A signal modulation controller 320 is provided to control and modulate the lasers in the laser array 310 so that the laser beams 312 are modulated to carry the image to be displayed on the screen 101. The signal modulation controller 320 can include a digital image processor that generates digital image signals for the three different color channels and laser driver circuits that produce laser control signals carrying the digital image signals. The laser control signals are then applied to modulate the lasers, e.g., the currents for laser diodes, in the laser array 310.

The beam scanning is achieved by using a scanning module which can include, for example, a scanning mirror 340 such as a galvo mirror for the vertical scanning and a multi-facet polygon scanner 350 for the horizontal scanning. In FIG. 11A, the galvo mirror scanner 340 is upstream to the polygon scanner 350. In FIG. 11B, the galvo mirror scanner 340 is downstream to the polygon scanner 350. In both designs, a scan lens 360 is used to project the scanning beams form the polygon scanner 350 onto the screen 101. The scan lens 360 is designed to image each laser in the laser array 310 onto the screen 101. Each of the different reflective facets of the polygon scanner 350 simultaneously scans N horizontal lines where N is the number of lasers. In the illustrated example, the laser beams are first directed to the galvo mirror 340 and then from the galvo mirror 340 to the polygon scanner 350. The output scanning beams 120 are then projected onto the screen 101. A relay optics module 330 is placed in the optical path of the laser beams 312 to modify the spatial property of the laser beams 312 and to produce a closely packed bundle of beams 332 for scanning by the galvo mirror 340 and the polygon scanner 350 as the scanning beams 120 projected onto the screen 101 to excite the phosphors and to generate the images by colored light emitted by the phosphors.

In other implementations, the one or more scanners described in the above examples may be replaced with one or more resonant scanners or micro mechanical electrical system (MEMS) devices to scan the beams. These devices may scan the beam in at least one direction, where adding additional resonant scanners or MEMS devices may support driving a beam in a second direction. In yet implementations, a DLP (Digital Light Processor) may be employed to support directing a scanned beam to a screen.

The laser beams 120 are scanned spatially across the screen 101 to hit different color pixels at different times. Accordingly, each of the modulated beams 120 carries the image signals for the red, green and blue colors for each pixel at different times and for different pixels at different times. Hence, the beams 120 are coded with image information for different pixels at different times by the signal modulation controller 320. The beam scanning thus maps the time-domain coded image signals in the beams 120 onto the spatial pixels on the screen 101. For example, the modulated laser beams 120 can have each color pixel time equally divided into three sequential time slots for the three color subpixels for the three different color channels. The modulation of the beams 120 may use pulse modulation techniques to produce desired grey scales in each color, a proper color combination in each pixel, and desired image brightness.

In one implementation, the multiple beams 120 are directed onto the screen 101 at different and adjacent vertical positions with two adjacent beams being spaced from each other on the screen 101 by one horizontal line of the screen 101 along the vertical direction. For a given position of the galvo mirror 340 and a given position of the polygon scanner 350, the beams 120 may not be aligned with each other along the vertical direction on the screen 101 and may be at different positions on the screen 101 along the horizontal direction. The beams 120 can only cover one portion of the screen 101. At a fixed angular position of the galvo mirror 340, the spinning of the polygon scanner 350 causes the beams 120 from N lasers in the laser array 310 to scan one screen segment of N adjacent horizontal lines on the screen 101. At the end of each horizontal scan over one screen segment, the galvo mirror 340 is adjusted to a different fixed angular position so that the vertical positions of all N beams 120 are adjusted to scan the next adjacent screen segment of N horizontal lines. This process iterates until the entire screen 101 is scanned to produce a full screen display.

Figure 11C:
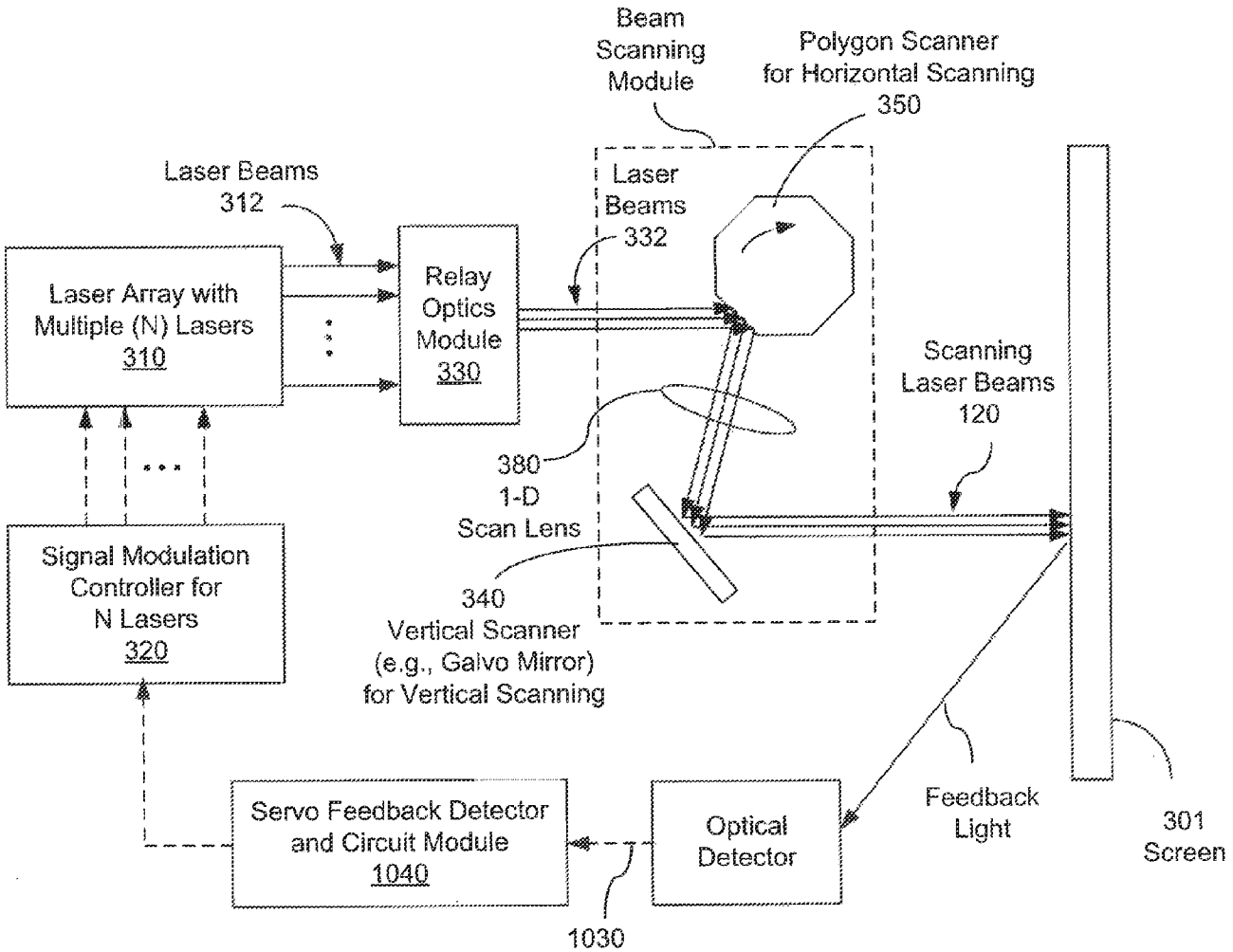

FIG. 11C shows an example implementation of a post-objective scanning beam display system based on the system design in FIG. 9. In this design, the relay optics module 330 reduces the spacing of laser beams 312 to form a compact set of laser beams 332 that spread within the facet dimension of the polygon scanner 350 for the horizontal scanning. Downstream from the polygon scanner 350, there is a 1-D horizontal scan lens 380 followed by a vertical scanner 340 (e.g., a galvo mirror) that receives each horizontally scanned beam 332 from the polygon scanner 350 through the 1-D scan lens 380 and provides the vertical scan on each horizontally scanned beam 332 at the end of each horizontal scan prior to the next horizontal scan by the next facet of the polygon scanner 350. Notably, the 1-D scan lens 380 is placed downstream from the polygon scanner 350 and upstream from the vertical scanner 340 to focus each horizontal scanned beam on the screen 101 and minimizes the horizontal bow distortion to displayed images on the screen 101. Such a 1-D scan lens 380 capable of producing a straight horizontal scan line is relatively simpler and less expensive than a 2-D scan lens of similar performance. Downstream from the scan lens 380, the vertical scanner 340 is a flat reflector and simply reflects the beam to the screen 101 and scans vertically to place each horizontally scanned beam at different vertical positions on the screen 101 for scanning different horizontal lines. The dimension of the reflector on the vertical scanner 340 along the horizontal direction is sufficiently large to cover the spatial extent of each scanning beam coming from the polygon scanner 350 and the scan lens 380.

Figure 12:
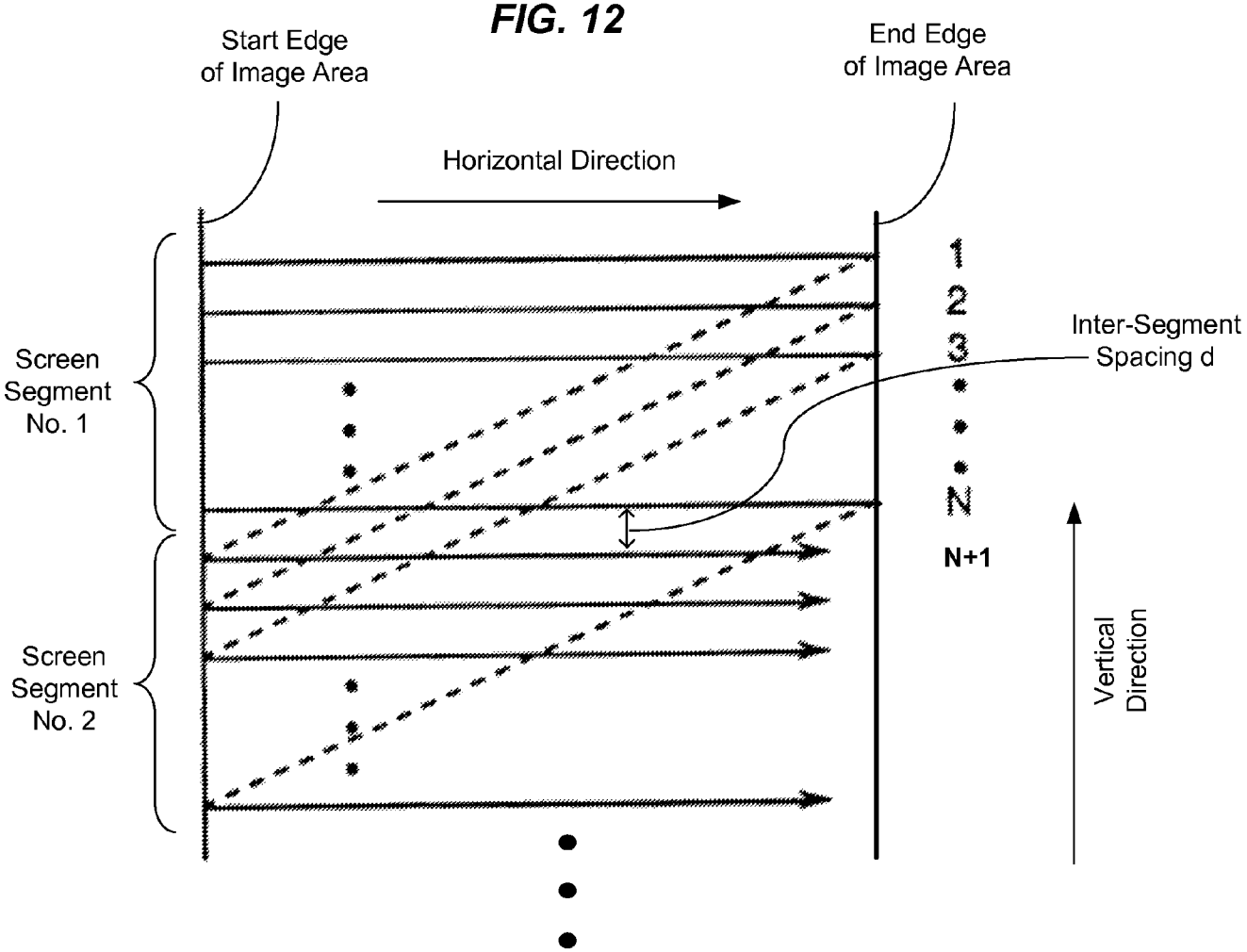
FIG. 12 illustrates one example of simultaneous scanning of multiple screen segments with multiple scanning laser beams.

Beam scanning can be performed in various ways by the scanning module. FIG. 12 illustrates an example of simultaneous scanning of one screen segment with multiple scanning laser beams at a time and sequentially scanning consecutive screen segments. Visually, the beams 120 behaves like a paint brush to "paint" one thick horizontal stroke across the screen 101 at a time to cover one screen segment and then subsequently to "paint" another thick horizontal stroke to cover an adjacent vertically shifted screen segment. Assuming the laser array 310 has 36 lasers, a 1080-line progressive scan of the screen 101 would require scanning 30 vertical screen segments for a full scan. Hence, this configuration in an effect divides the screen 101 along the vertical direction into multiple screen segments so that the N scanning beams scan one screen segment at a time with each scanning beam scanning only one line in the screen segment and different beams scanning different sequential lines in that screen segment. After one screen segment is scanned, the N scanning beams are moved at the same time to scan the next adjacent screen segment.

Therefore, the N diode lasers produce modulated laser excitation beams of the excitation light at the single excitation wavelength, one modulated laser excitation beam from each diode laser per one laser current control signal carrying images of different colors in the respective laser current control signal. The beam scanning scans, simultaneously and along the direction perpendicular to the phosphor stripes, the modulated laser excitation beams on to the display screen at different and adjacent screen positions along the longitudinal direction of the phosphor stripes in one screen segment of the display screen, to produce different scan lines, respectively, in the screen segment, to cause fluorescent layer of the display screen to emit light of red, green and blue colors at different times at different positions in each scan line and, to shift, simultaneously, the modulated laser excitation beams to other screen segments at different positions in the display screen along the vertical direction, one screen segment at a time, to render the images.

In the above design with multiple laser beams, each scanning laser beam scans only a number of lines across the entire screen along the vertical direction that is equal to the number of screen segments, and, within each screen segment, several beams simultaneously scan multiple lines. Hence, the polygon scanner for the horizontal scanning can operate at a slower speed than a scanning speed needed for a single beam scan design that uses the single beam to scan every line of the entire screen. For a given number of total horizontal lines on the screen (e.g., 1080 lines in HDTV), the number of screen segments decreases as the number of the lasers increases. Hence, in a system that uses 36 lasers to produce 36 excitation laser beams, the galvo mirror 340 and the polygon scanner 350 scan 30 lines per frame while a total of 108 lines per frame are scanned when there are only 10 lasers. Hence, the use of the multiple lasers can increase the image brightness which is approximately proportional to the number of lasers used and, at the same time, can also advantageously reduce the response speeds of the scanning module.

The vertical beam pointing accuracy is controlled within a threshold in order to produce a high quality image. When multiple scanning beams are used to scan multiple screen segments, this accuracy in the vertical beam pointing should be controlled to avoid or minimize an overlap between two adjacent screen segments because such an overlap in the vertical direction can severely degrade the image quality. The vertical beam pointing accuracy should be less than the width of one horizontal line in implementations.

In the above scanning beam systems, each of the one or more laser beams 120 is scanned spatially across the light-emitting screen 101 to hit different color pixels at different times. Accordingly, the modulated beam 120 carries the image signals for the red, green and blue for each pixel at different times and for different pixels at different times. Hence, the modulation of the beam 120 is coded with image information for different pixels at different times to map the timely coded image signals in the beam 120 to the spatial pixels on the screen 101 via the beam scanning. The beam scanning converts the timely coded image signals in form of optical pulses into spatial patterns as displayed images on the screen 101.

Figure 13:
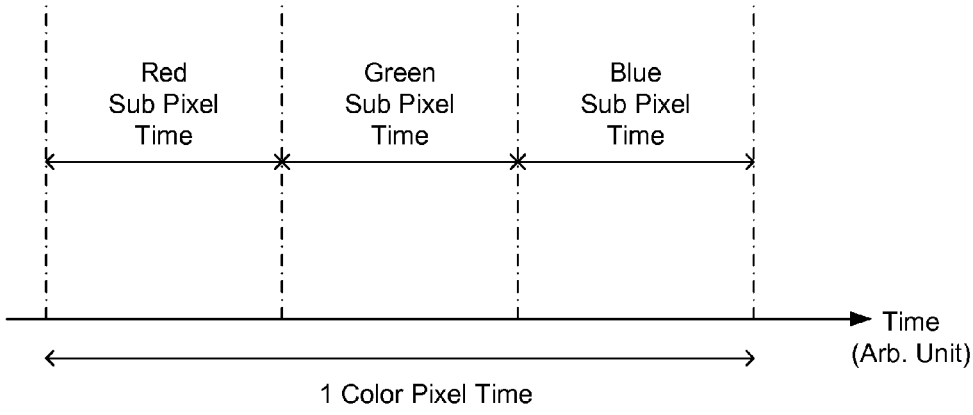
FIGS. 13, 14, 15, 16, 17A and 17B show examples of time-domain signal modulations for generating image-carrying optical pulses in each scanning optical beam.

FIG. 13 shows one example for time division on the modulated laser beam 120 where each color pixel time is equally divided into three sequential time slots for the three color channels. The modulation of the beam 120 may use pulse modulation techniques to produce desired grey scales in each color, proper color combination in each pixel, and desired image brightness.

Figure 14:
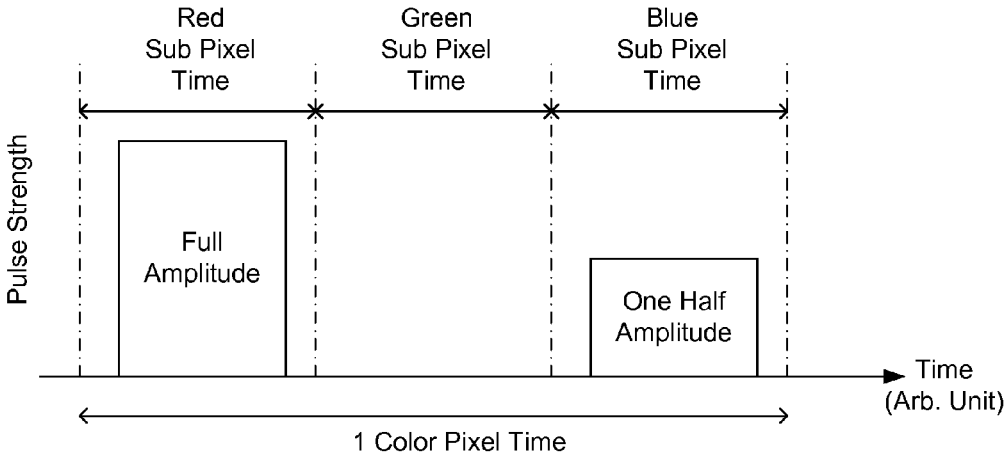

FIGS. 14, 15, 16, 17A and 17B illustrate examples of some pulse modulation techniques. FIG. 14 shows an example of a pulse amplitude modulation (PAM) where the amplitude of the optical pulse in each time slot produces the desired grey scale and color when combined with other two colors within the same pixel. In the illustrated example, the pulse during the red sub pixel time is at its full amplitude, the pulse during the green sub pixel time is zero, and the pulse during the blue sub pixel time is one half of the full amplitude. PAM is sensitive to noise. As an improvement to PAM, a pulse code modulation (PCM) may be used where the amplitude values of the pulse are digitized. PCM is widely used in various applications.

Figure 15:
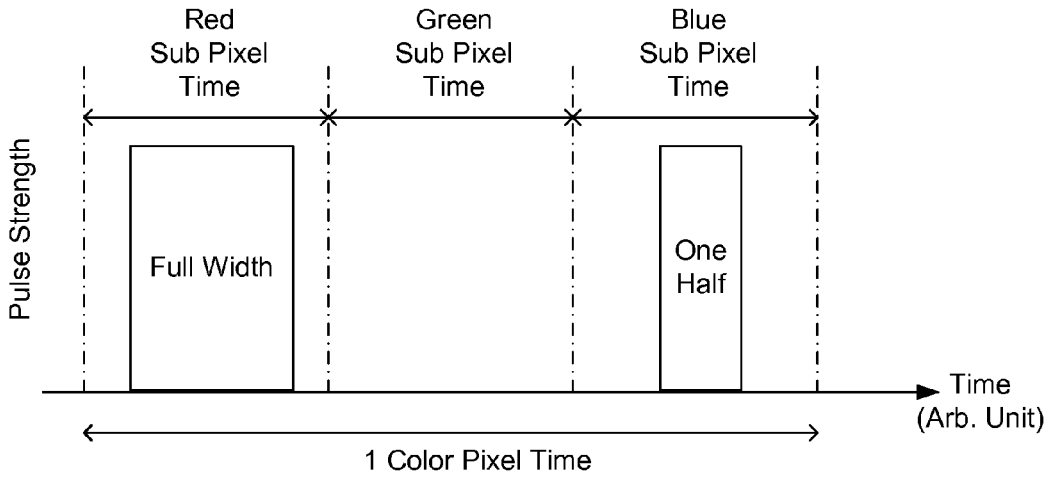

FIG. 15 shows another pulse modulation technique where each pulse is at a fixed amplitude but the pulse width or duration is changed or modulated to change the total energy of light in each color sub pixel. The illustrated example in FIG. 15 for the pulse width modulation (PWM) shows a full width pulse in red, no pulse in green and a pulse with one half of the full width in blue.

Figure 16:
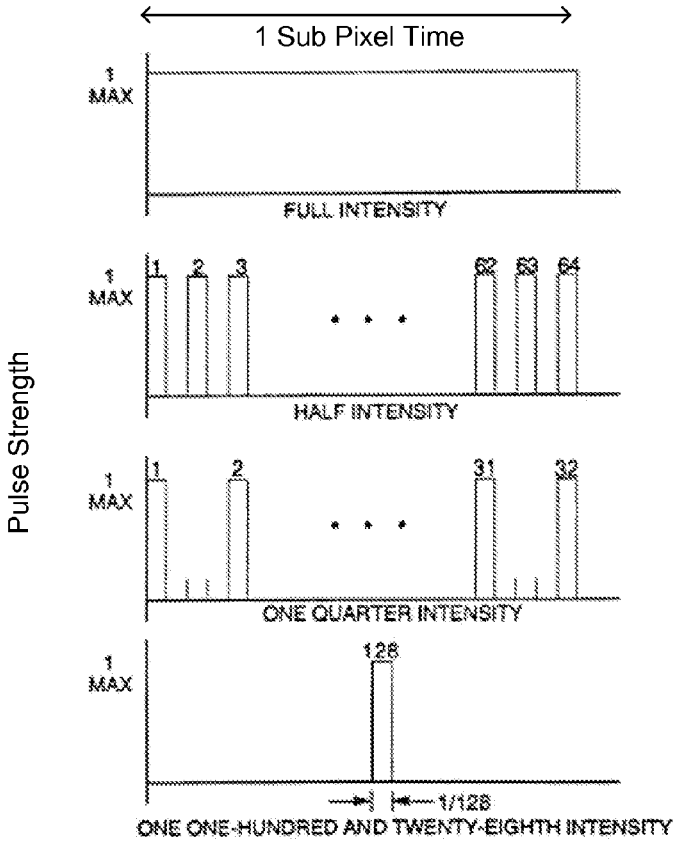

FIG. 16 illustrates another example of the PWM for producing N (e.g., N=128) grey scales in each color sub pixel. Each pixel time is equally divided into N time slots. At the full intensity, a single pulse for the entire duration of the sub pixel time at the full amplitude is produced. To generate the one half intensity, only 64 pulses with the full amplitude in alternating time slots, 1, 3, 5, 7, . . . , 127 are generated with the sub pixel time. This method of using equally spaced pulses with a duration of 1/N of the sub pixel time can be used to generate a total of 128 different grey levels. For practical applications, the N may be set at 256 or greater to achieve higher grey levels.

Figure 17A:
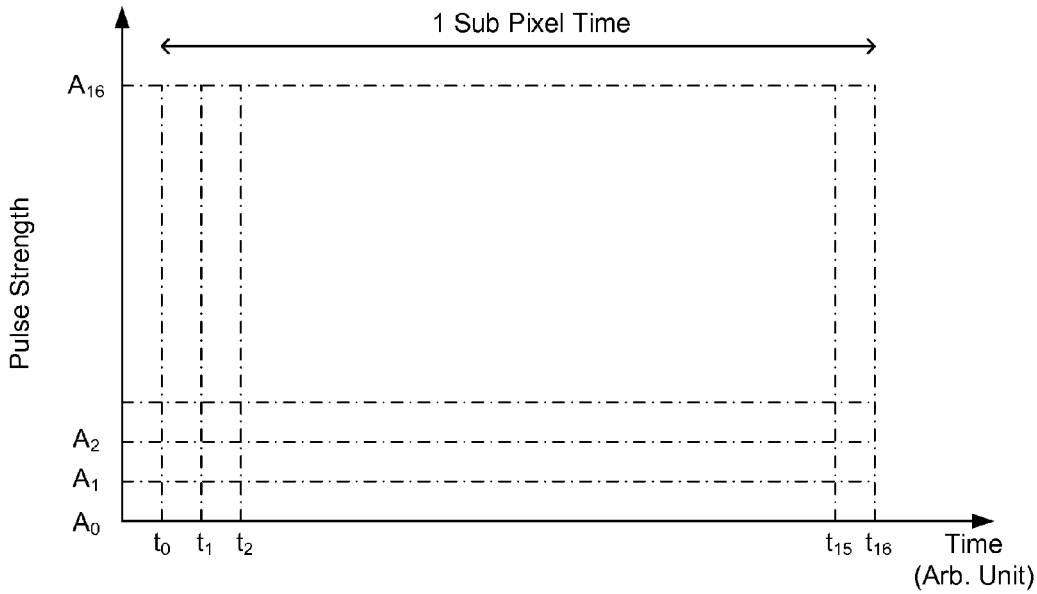
Figure 17B:
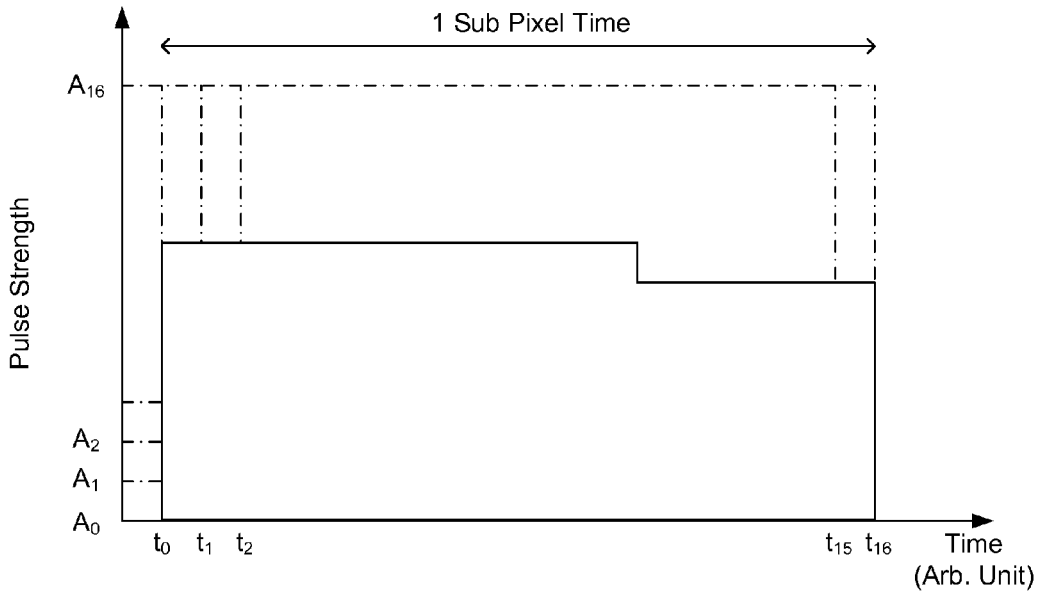

FIGS. 17A and 17B illustrate another example of a pulse modulation technique that combines both the PCM and PWM to produce N grey scales. In the PCM part of this modulation scheme, the full amplitude of the pulse is divided into M digital or discrete levels and the full sub pixel time is divided into multiple equal sub pulse durations, e.g., M sub pulse durations. The combination of the PCM and PWD is N=M×M grey scales in each color sub pixel. As an example, FIG. 17A shows that a PCM with 16 digital levels and a PWM with 16 digital levels. In implementation, a grey scale may be achieved by first filling the pulse positions at the lowest amplitude level A1. When all 16 time slots are used up, the amplitude level is increased by one level to A2 and then the time slots sequentially filled up. FIG. 17B shows one example of a color sub pixel signal according to this hybrid modulation based on PCM and PWM. The above hybrid modulation has a number of advantages. For example, the total number of the grey levels is no longer limited by the operating speed of the electronics for PCM or PWM alone.

The above signal coding techniques, PAM, PCM and PWM, and their combinations, or other suitable signal coding techniques, can be applied to a scanning beam display system that scans colored red, green and blue beams onto a passive screen for displaying colored images.

In the above beam scanning devices, the location of a scanning beam on the screen is needed for several operations, including properly delivering a laser pulse of the excitation light onto a proper location where a red, green or blue phosphor stripe is located, and addressing a pixel location for performing either or both of the temporal integration and spatial averaging of adjacent pixels to achieve dithered pixel brightness levels beyond the default DAC levels for operating diode lasers.

More specifically, consider the example in the scanning system in FIG. 9. The optical module 110 uses the position information of the beam 120 on the screen relative to the phosphor stripes in order to properly deliver optical pulses so that the pulses carrying a particular color (e.g., red) imaging information hit on proper color phosphor stripes (e.g., red). This position information of the one or more optical beams 120 can be obtained via various techniques.

One example is to generate optical feedback light in real time by each scanning optical beam 120 via one or more optical reference marks on the screen to produce the optical feedback light. A designated optical detector located off the screen can be used to collect the optical feedback light and to convert the collected optical feedback light into a detector signal that contains the real-time position information 1030. In FIGS. 11A, 11B and 11C, a servo feedback detector and circuit module 1040 is shown to illustrate this feature. This information is then fed to the signal modulation controller 320.

Examples of optical reference marks for the screen 101 are described below.

Alignment reference marks can be implemented on the screen 101 to determine the relative position of the beam on the screen and other parameters of the excitation beam on the screen. For example, during a horizontal scan of the excitation beam 120 across the fluorescent stripes, a start of line (SOL) mark can be provided for the system to determine the beginning of the active fluorescent display area of the screen 101 so that the signal modulation controller of the system can begin deliver optical pulses to the targeted pixels. An end of line (EOL) mark can also be provided for the system to determine the end of the active fluorescent display area of the screen 101 during a horizontal scan. For another example, a vertical alignment referenced mark can be provided for the system to determine whether the beam 120 is pointed to a proper vertical location on the screen. Other examples for reference marks may be one or more reference marks for measuring the beam spot size on the screen and one or more reference marks on the screen to measure the optical power of the excitation beam 120. Such reference marks can be placed a region outside the active fluorescent area of the screen 101, e.g., in one or more peripheral regions of the active fluorescent screen area.

Figure 18:
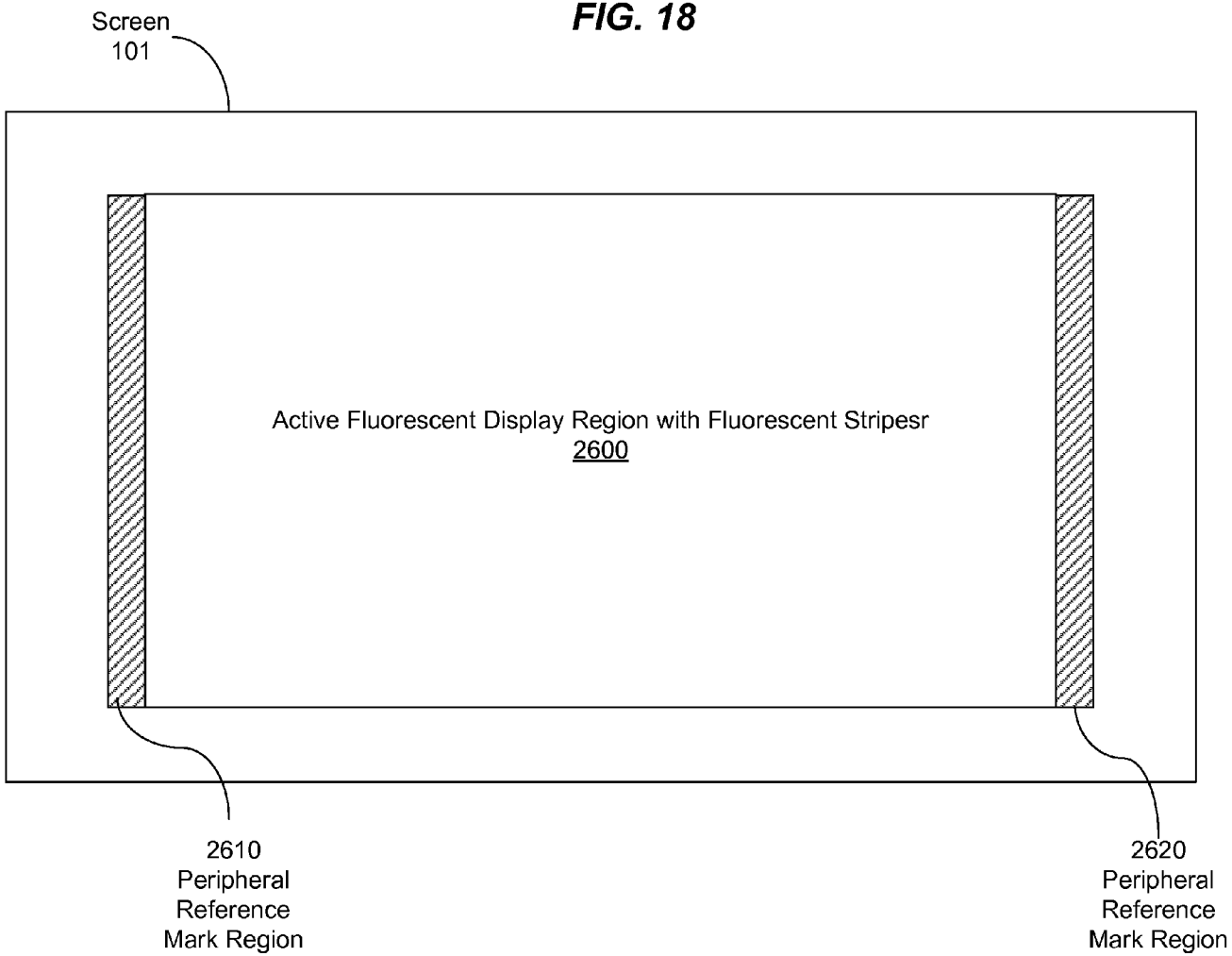
FIG. 18 shows an example of a fluorescent screen having peripheral reference mark regions that include servo reference marks that produce feedback light for various servo control functions.

FIG. 18 illustrates one example of a fluorescent screen 101 having peripheral reference mark regions. The screen 101 includes a central active fluorescent area 2600 with parallel fluorescent stripes for displaying images, two stripe peripheral reference mark regions 2610 and 2620 that are parallel to the fluorescent stripes. Each peripheral reference mark region can be used to provide various reference marks for the screen 101. In some implementations, only the left peripheral reference mark region 2610 is provided without the second region 2620 when the horizontal scan across the fluorescent stripes is directed from the left to the right of the area 2600. The reference mark features described here can also be applied to passive screens which do not have the light-emitting materials where the central active fluorescent area 2600 in FIG. 18 is simply the central passive area of a passive screen.

Such a peripheral reference mark region on the screen 101 allows the scanning display system to monitor certain operating parameters of the system. Notably, because a reference mark in the peripheral reference mark region is outside the active fluorescent display area 2600 of the screen 101, a corresponding servo feedback control function can be performed outside the duration during the display operation when the excitation beam is scanning through the active fluorescent display area 2600 to display image. Therefore, a dynamic servo operation can be implemented without interfering the display of the images to the viewer. In this regard, each scan can include a CW mode period when an excitation beam sans through the peripheral referenced mark region for the dynamic servo sensing and control and a display mode period when the modulation of the excitation beam is turned on to produce image-carrying optical pulses as the excitation beam sans through the active fluorescent display area 2600.

Figure 19:
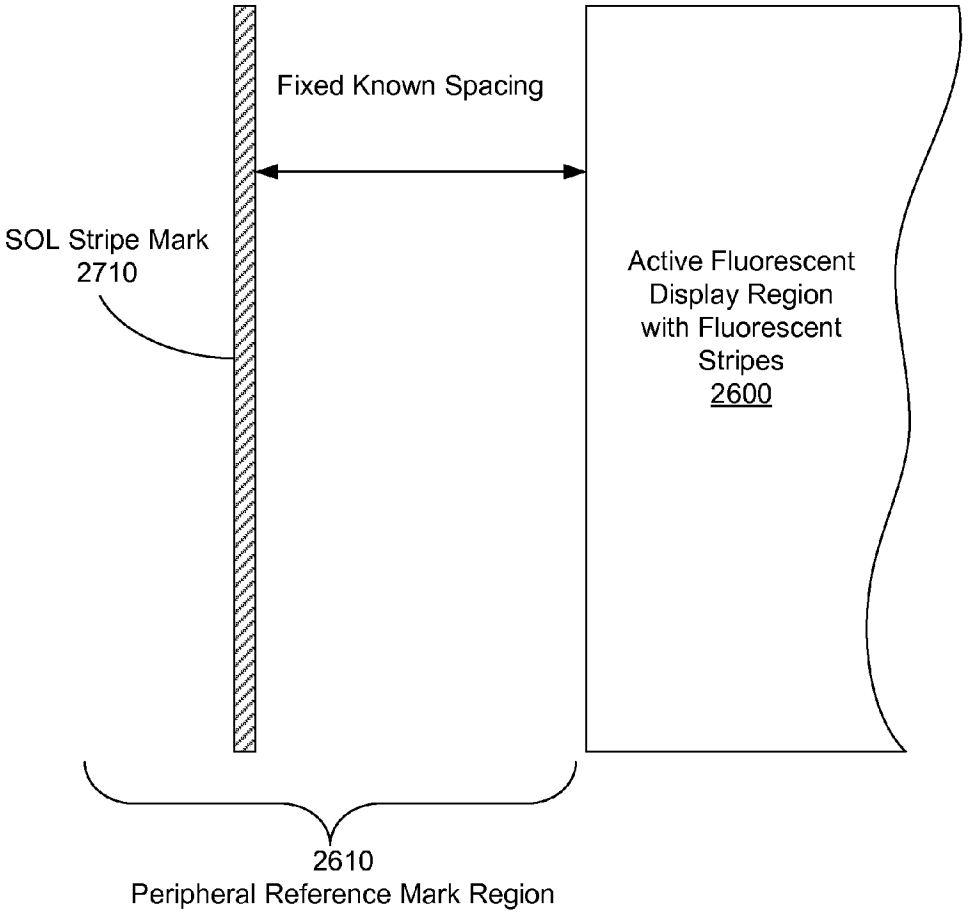
FIG. 19 shows a start of line reference mark in a peripheral reference mark region to provide a reference for the beginning of the active fluorescent area on the screen.

FIG. 19 shows an example of a start of line (SOL) reference mark 2710 in the left peripheral region 2610 in the screen 101. The SOL reference mark 2710 can be an optically reflective, diffusive or fluorescent stripe parallel to the fluorescent stripes in the active fluorescent region 2600 of the screen 101. The SOL reference mark 2710 is fixed at a position with a known distance from the first fluorescent stripe in the region 2600. SOL patterns may include multiple vertical lines with uniform or variable spacing. Multiple lines are selected for redundancy, increasing signal to noise, accuracy of position (time) measurement, and providing missing pulse detection.

In operation, the scanning excitation beam 120 is scanned from the left to the right in the screen 101 by first scanning through the peripheral reference mark region 2610 and then through the active fluorescent region 2600. When the beam 120 is in the peripheral reference mark region 2610, the signal modulation controller in the laser module 110 of the system sets the beam 120 in a CW mode without the modulated optical pulses that carry the image data. When the scanning excitation beam 120 scans through the SOL reference mark 2710, the light reflected, scattered or emitted by the SOL reference mark 2710 due to the illumination by the excitation beam 2710 can be measured at an SOL optical detector located near the SOL reference mark 2710. The presence of this signal indicates the location of the beam 120. The SOL optical detector can be fixed at a location in the region 2610 on the screen 101 or off the screen 101. Therefore, the SOL reference mark 2710 can be used to allow for periodic alignment adjustment during the lifetime of the system.

The laser beam is turned on continuously as a CW beam before the beam reaches the SOL mark 2710 in a scan. When the pulse from the SOL detected is detected, the laser can be controlled to operate in the image mode and carry optical pulses with imaging data. The system then recalls a previously measured value for the delay from SOL pulse to beginning of the image area. This process can be implemented in each horizontal scan to ensure that each line starts the image area properly aligned to the color stripes. The correction is made prior to painting the image for that line, so there is no lag in correction allowing for both high frequency (up to line scan rate) and low frequency errors to be corrected.

Physical implementation of the SOL sensor may be a reflective (specular or diffuse) pattern with an area detector(s), an aperture mask with light pipe to collect the transmitted light into a single detector or multiple detectors.

With the reflective method, multiple lasers on and passing over reflective areas simultaneously may create self interference. A method to prevent this is to space the laser beams such that only one active beam passes over the reflective area at a time. Some optical reflection may come from the image area of the screen. To prevent this from interfering with the SOL sensor signal, the active laser beams may be spaced such that no other laser beams are active over any reflective area when the desired active laser beam is passing over the reflective SOL sensor area. The transmission method is not affected by reflections from the image area.

Similar to the SOL mark 2710, an end-of-line (EOL) reference mark can be implemented on the opposite side of the screen 101, e.g., in the peripheral reference mark region 2620 in FIG. 18. The SOL mark is used to ensure the proper alignment of the laser beam with the beginning of the image area. This does not ensure the proper alignment during the entire horizontal scan because the position errors can be present across the screen. Implementing the EOL reference mark and an end-of-line optical detector in the region 2620 can be used to provide a linear, two point correction of laser beam position across the image area.

When both SOL and EOL marks are implemented, the laser is turned on continuously in a continuous wave (CW) mode prior to reaching the EOL sensor area. Once the EOL signal is detected, the laser can be returned to image mode and timing (or scan speed) correction calculations are made based on the time difference between the SOL and EOL pulses. These corrections are applied to the next one or more lines. Multiple lines of SOL to EOL time measurements can be averaged to reduce noise.

In addition to control of the horizontal beam position along the scan direction perpendicular to the fluorescent stripes, the beam position along the vertical position parallel to the fluorescent stripes can also be monitored and controlled to ensure the image quality. Referring to FIG. 10, each fluorescent stripe may not have any physical boundaries between two pixels along the vertical direction. This is different from the pixilation along the horizontal scan direction perpendicular to the fluorescent stripes. The pixel positions along the fluorescent stripes are controlled by the vertical beam position on the screen to ensure a constant and uniform vertical pixel positions without overlapping and gap between two different horizontal scan lines. Referring to the multi-beam scanning configuration in FIG. 12, when multiple excitation beams are used to simultaneously scan consecutive horizontal scan within one screen segment on the screen, the proper vertical alignment of the lasers to one another are important to ensure a uniform vertical spacing between two adjacent laser beams on the screen and to ensure a proper vertical alignment between two adjacent screen segments along the vertical direction. In addition, the vertical positioning information on the screen can be used to provide feedback to control the vertical scanner amplitude and measure the linearity of the vertical scanner.

Vertical position of each laser can be adjusted by using an actuator, a vertical scanner such as the galvo mirror 340 in FIGS. 11A, 11B and 11C, an adjustable lens in the optical path of each laser beam or a combination of these and other mechanisms. Vertical reference marks can be provided on the screen to allow for a vertical servo feedback from the screen to the laser module. One or more reflective, fluorescent or transmissive vertical reference marks can be provided adjacent to the image area of the screen 101 to measure the vertical position of each excitation beam 120. Referring to FIG. 11, such vertical reference marks can be placed in a peripheral reference mark region. One or more vertical mark optical detectors can be used to measure the reflected, fluorescent or transmitted light from a vertical reference mark when illuminated by the excitation beam 120. The output of each vertical mark optical detector is processed and the information on the beam vertical position is used to control an actuator to adjust the vertical beam position on the screen 101.

Figure 20:
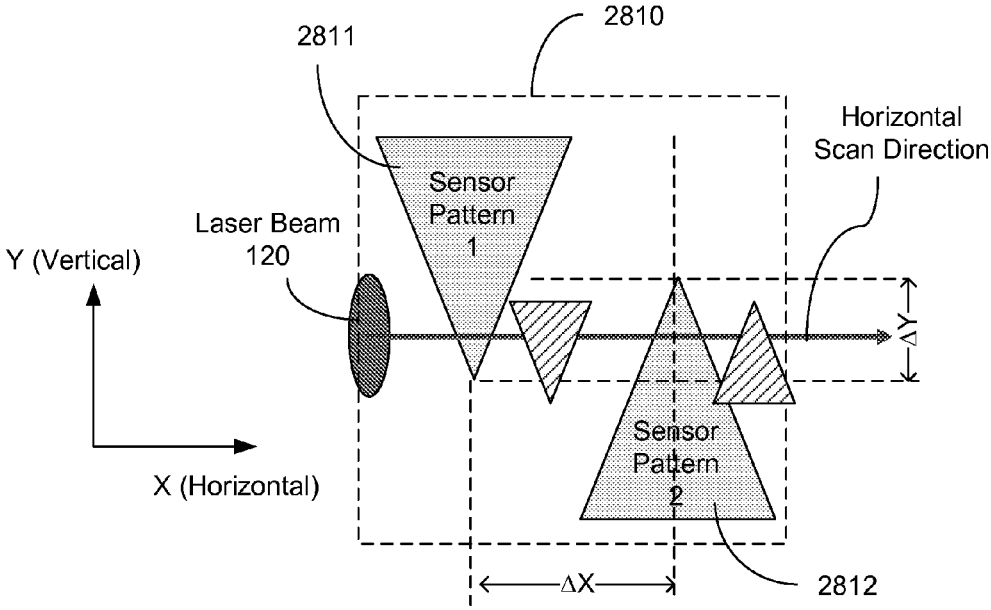
FIG. 20 shows an example of a vertical beam position reference mark for the screen in FIG. 19.

FIG. 20 shows an example of a vertical reference mark 2810. The mark 2810 includes is a pair of identical triangle reference marks 2811 and 2812 that are separated and spaced from each other in both vertical and horizontal directions to maintain an overlap along the horizontal direction. Each triangle reference mark 2811 or 2812 is oriented to create a variation in the area along the vertical direction so that the beam 120 partially overlaps with each mark when scanning through the mark along the horizontal direction. As the vertical position of the beam 120 changes, the overlapping area on the mark with the beam 120 changes in size. The relative positions of the two marks 2811 and 2812 defines a predetermined vertical beam position and the scanning beam along a horizontal line across this predetermined vertical position scans through the equal areas as indicated by the shadowed areas in the two marks 2811 and 2812. When the beam position is above this predetermined vertical beam position, the beam sees a bigger mark area in the first mark 2811 than the mark area in the second mark 2812 and this difference in the mark areas seen by the beam increases as the beam position moves further up along the vertical direction. Conversely, when the beam position is below this predetermined vertical beam position, the beam sees a bigger mark area in the second mark 2812 than the mark area in the first mark 2811 and this difference in the mark areas seen by the beam increases as the beam position moves further down along the vertical direction.

The feedback light from each triangle mark is integrated over the mark and the integrated signals of the two marks are compared to produce a differential signal. The sign of the differential signal indicated the direction of the offset from the predetermined vertical beam position and the magnitude of the differential signal indicates the amount of the offset. The excitation beam is at the proper vertical position when the integrated light from each triangle is equal, i.e., the differential signal is zero.

Figure 21A:
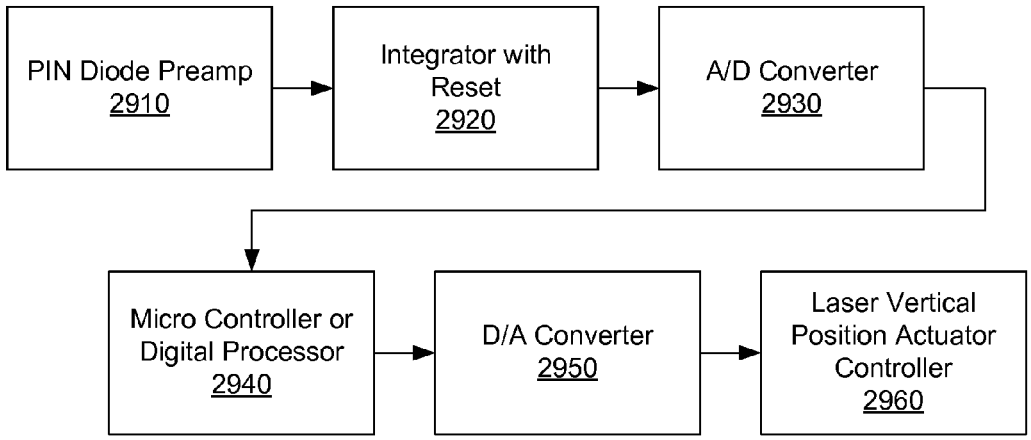
FIGS. 21A and 21B show a servo feedback control circuit and its operation in using the vertical beam position reference mark in FIG. 20 to control the vertical beam position on the screen.
Figure 21B:
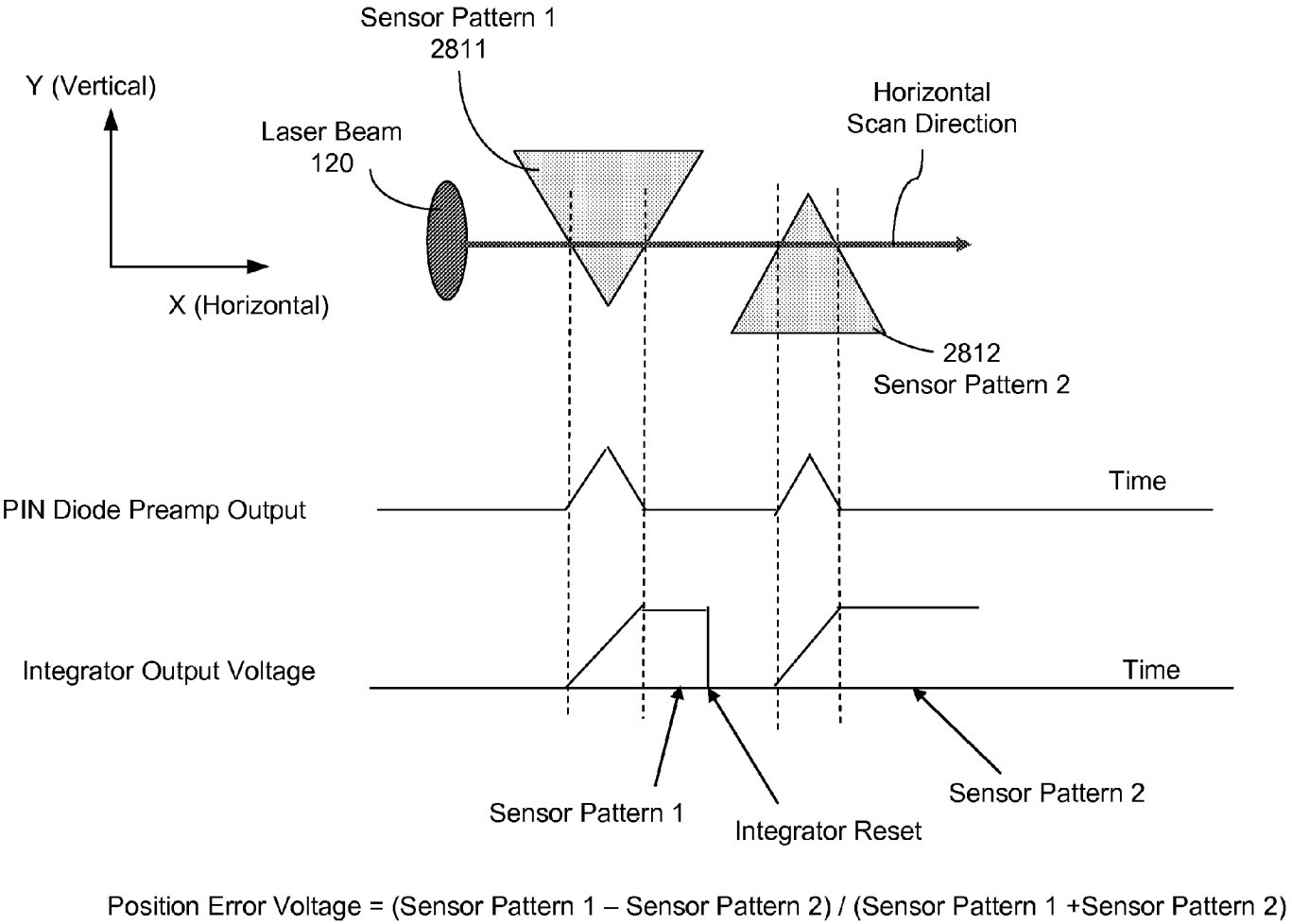

FIG. 21A shows a portion of the signal processing circuit as part of the vertical beam position servo feedback control in the laser module 110 for the vertical reference mark. A PIN diode preamplifier 2910 receives and amplifies the differential signal for the two reflected signals from the two marks 2811 and 2812 and directs the amplified differential signal to an integrator 2920. An analog-to-digital converter 2930 is provided to convert the differential signal into a digital signal. A digital processor 2940 processes the differential signal to determine the amount and direction of the adjustment in the vertical beam position and accordingly produces a vertical actuator control signal. This control signal is converted into an analog control signal by a digital to analog converter 2950 and is applied to a vertical actuator controller 2960 which adjusts the actuator. FIG. 21B further shows generation of the differential signal by using a single optical detector.

Figure 22:
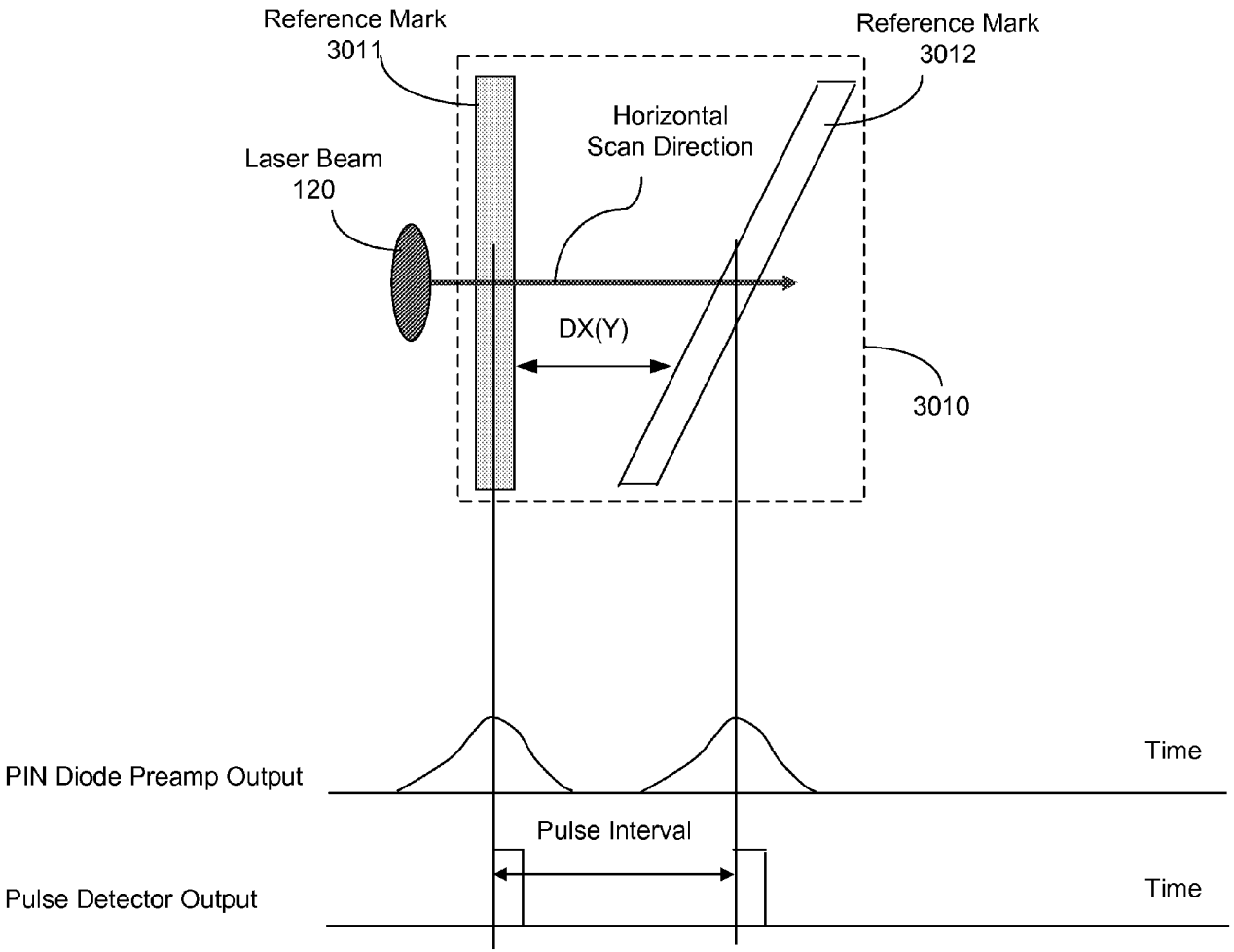
FIGS. 22 and 23 show another example of a vertical beam position reference mark for the screen in FIG. 18 and a corresponding servo feedback control circuit.

FIG. 22 shows another example of a vertical reference mark 3010 and a portion of the signal processing in a servo control circuit. The mark 3010 includes a pair of reference marks 3011 and 3012 that are separated and spaced from each other in the horizontal scan direction and the horizontal distance DX(Y) between the two marks 3011 and 3012 is a monotonic function of the vertical beam position Y. The first mark 3011 can be a vertical stripe and the second mark 3012 can be a stripe at a slanted angle from the vertical direction. For a given horizontal scanning speed on the screen, the time for the beam to scan from the first mark 3011 to the second mark 3022 is a function of the vertical beam position. For a predetermined vertical beam position, the corresponding scan time for the beam to scan through the two marks 3011 and 3012 is a fixed scan time. One or two optical detectors can be used to detect the reflected light from the two marks 3011 and 3012 and the two optical pulses or peaks reflected by the two marks for the excitation beam 120 in the CW mode can be measured to determine the time interval between the two optical pulses. The difference between the measured scan time and the fixed scan time for the predetermined vertical beam position can be used to determine the offset and the direction of the offset in the vertical beam position. A feedback control signal is then applied to the vertical actuator to reduce the vertical offset.

Figure 23:
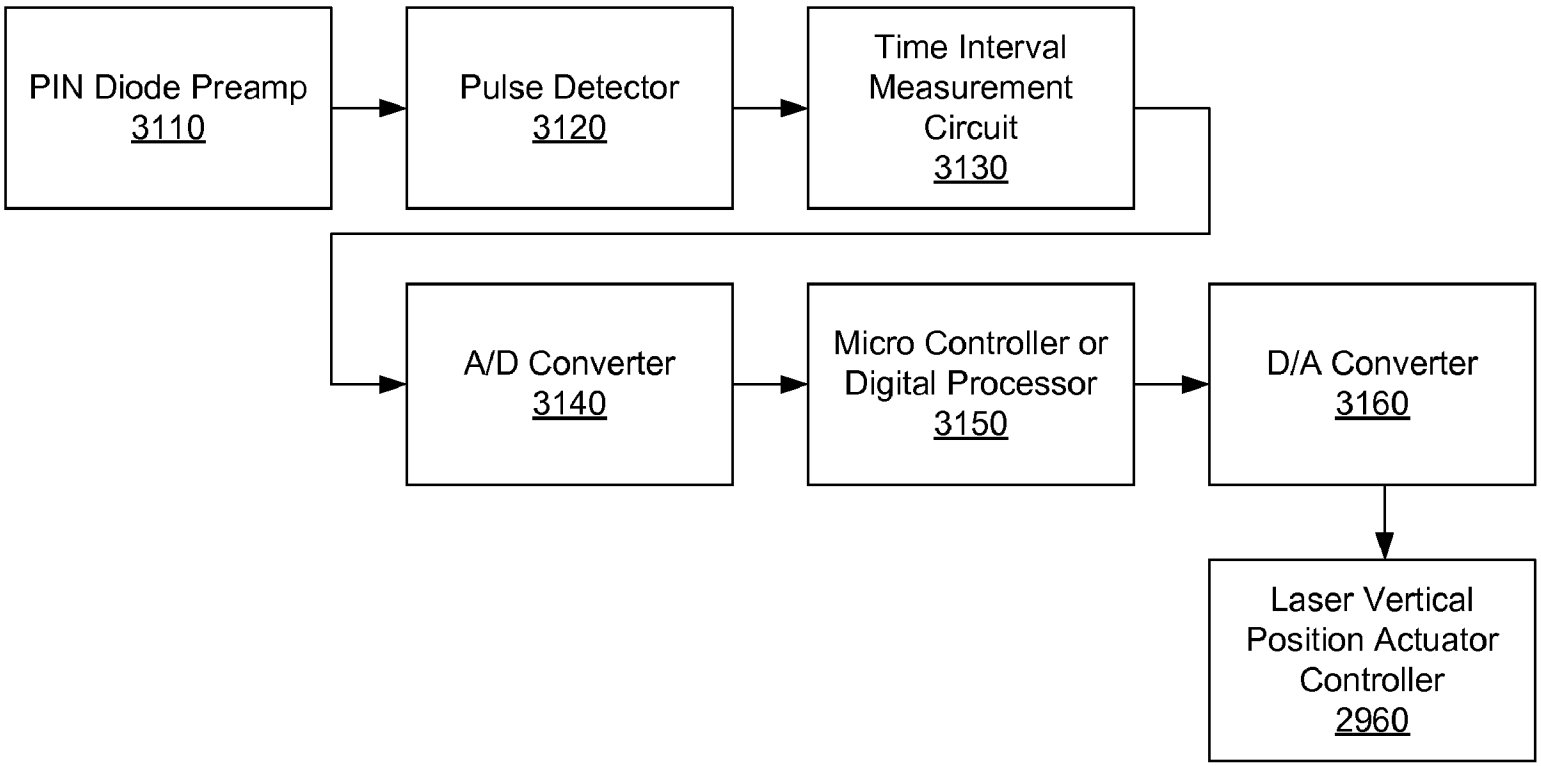

FIG. 23 shows a portion of the signal processing circuit as part of the vertical beam position servo feedback control in the laser module 110 for the vertical reference mark in FIG. 22. A PIN diode preamplifier 3110 receives and amplifies the detector output signal from an optical detector that detects the reflected light from the two marks 3011 and 3012 during a horizontal scan. The amplified signal is processed by a pulse detector 3120 to produce corresponding pulses corresponding to the two optical pulses at different times in the reflected light. A time interval measurement circuit 3130 is used to measure the time between the two pulses and this time measurement is converted into a digital signal in an analog to digital converter 3140 for processing by a digital processor 3150. The digital processor 3150 determines the amount and direction of an adjustment in the vertical beam position based on the measured time and accordingly produces a vertical actuator control signal. This control signal is converted into an analog control signal by a digital to analog converter 3160 and is applied to a vertical actuator controller 2960 which adjusts the actuator.

A vertical reference mark may also be implemented by using a single triangular reference mark shown in FIG. 20 where the single triangle reference mark 2811 or 2812 is oriented to create a variation in the horizontal dimension of the mark along the vertical direction so that the beam 120 partially overlaps with the mark when scanning through the mark along the horizontal direction. When the vertical position of the beam 120 changes, the horizontal width of the mark scanned by the beam 120 changes. Hence, when the beam 120 scans over the mark, an optical pulse is generated in the reflected or fluorescent light generated by the mark and the width of the generated optical pulse is proportional to the horizontal width of the mark which is a function of the vertical beam position. At a predetermined vertical beam position, the optical pulse width is a fixed value. Therefore, this fixed optical pulse width can be used as a reference to determine the vertical position of the beam 120 relative to the predetermined vertical beam position based on the difference between the optical pulse width associated with the scanning of the beam 120 across the mark. An optical detector can be placed near the mark to detector the reflected or fluorescent light from the mark and the difference in the width of the pulse from the fixed value can be used to as a feedback control to adjust the vertical actuator for the beam 120 to reduce the offset of the vertical beam position.

In implementing multiple lasers for simultaneously scanning consecutive lines within one of multiple screen segments as shown in FIG. 12, two separate vertical positioning servo control mechanisms can be implemented. The first vertical positioning servo control is to control the line to line spacing of different horizontal lines scanned by different lasers at the same time within each screen segment. Accordingly, at each line, a vertical reference mark and an associated optical detector are needed to provide servo feedback to control the vertical beam position of each laser beam. Hence, this first vertical servo control mechanism includes N vertical servo feedback controls for the N lasers, respectively.

The second vertical positioning servo control is to control the vertical alignment between two adjacent screen segments by using the galvo mirror to vertically move all N laser beams, after completion of scanning one screen segment, to an adjacent screen segment. This can be achieved by controlling the galvo mirror to make a common adjustment in the vertical direction for all N laser beams. The vertical reference mark in the peripheral reference mark region 2610 in FIG. 18 and the associated optical detector for the top line in each screen segment can be used to measure the vertical position of the first of the N laser beams when the beams are still scanning through the peripheral reference mark region 2610 in FIG. 18. This vertical information obtained in this measurement is used as a feedback signal to control the vertical angle of the galvo mirror to correct any vertical error indicated in the measurement. In implementations, this correction can lead to a small amplitude (micro-jog) correction signal to the vertical galvo for that scan line.

The vertical alignment between two adjacent screen segments is determined by a number of factors, including the galvo linearity at different galvo angles of the galvo mirror 340, the polygon pyramidal errors of the polygon scanner 350, and optical system distortions caused by various reflective and refractive optical elements such as mirrors and lenses. The polygon pyramidal errors are errors in the vertical beam positions caused by different tilting angles in the vertical direction at different polygon facets of the polygon 350 due to the manufacturing tolerance. One manufacturing tolerance on the polygon mirror is the pyramidal error of the facets. The implementation of the second vertical positioning servo control can compensate for the polygon pyramidal errors and thus a relatively inexpensive polygon scanner can be used in the present scanning display systems without significantly compromising the display quality.

The second vertical servo control based on the galvo micro-jog correction signal can also use a look-up table of pyramidal error values of the polygon 350. The pyramidal errors in this look-up table can be obtained from prior measurements. When a pyramidal error does not change significantly with temperature, humidity and others, this look-up table method may be sufficient without using the servo feedback based on a measured vertical beam position using the vertical reference mark described above. In implementation, the feedback control needs the identification of the polygon facet that is currently scanning a line and thus can retrieve the corresponding pyramidal error value for that polygon facet from the look-up table. The identification of the current polygon facet can be determined from a facet number sensor on the polygon 350.

Based on the above mechanisms for measuring real-time beam position on the screen, a scanning beam display system can be constructed to provide temporal integration or spatial block averaging during the beam scanning for improved image brightness control beyond the default brightness levels dictated by the DAC levels in the laser control. In such a system, one or more light sources such as lasers are provided to produce one or more optical beams and a signal modulation controller is provided to be in communication with the one or more light sources to cause the one or more optical beams to be modulated as optical pulses that carry images to be displayed on the screen. An optical scanning module, which can include a vertical scanner and a polygon scanner, scans the one or more optical beams onto the screen to produce a raster scanning pattern for displaying the images. The signal modulation controller includes an image data storage device that stores data of the images to be displayed and operates to adjust optical energies of the optical pulses of the one or more optical beams with respect to positions of the one or more scanning optical beams on the screen to render the images on the screen. The signal modulation controller also includes a data storage device to store data of a predetermined spatial variation of at least one optical beam in connection with the location of the optical beam on the screen caused by one or more distortions in scanning the optical beam onto the screen. In operation, the signal modulation controller, in addition to adjusting optical energies of the optical pulses for rendering the images, adjusts optical energies of the optical pulses of at least one optical beam, based on the stored data on the predetermined spatial variation of the optical beam, to reduce the one or more distortions in the images displayed on the screen.

In some implementations, the predetermined spatial variation of the optical beam in connection with the location of the optical beam on the screen includes a variation in a beam spot size of the optical beam on the screen as the optical beam is scanned through different locations on the screen. This variation in the beam spot size can also change the beam spot brightness perceived by the viewer and thus cause undesired variation in screen brightness from one location to another. In some system implementations, the variation of the beam spot size is localized and does not significantly extend to the adjacent beam spot on the screen. Under this circumstance, one way for counteracting to this variation in the beam spot size with location of the scanning beam on the screen is to decrease an optical energy of an optical pulse as the beam spot size on the screen decreases and/or increase an optical energy of an optical pulse as the beam spot size on the screen increases. In some system implementations, however, the variation of the beam size may lead to nearly overlap or actual overlap of two adjacent beam spots either in two adjacent scan lines or within the same scan line to cause a perceived increase in brightness. To mitigate this variation in the beam spot size with location of the scanning beam on the screen, the optical energy of an optical pulse can be decreased as the beam spot size on the screen increases in a region where two adjacent beam spots nearly overlap or actually overlap due to the variation of the beam size.

Hence, the optical energy of optical pulses in at least one optical beam can be adjusted during the beam scanning based on the location of the scanning optical beam and the predetermined distortion information at the location to reduce undesired brightness variations. The signal modulation controller, for example, can be used to control the signal modulation to provide this position-dependent adjustment to the optical energy of optical pulses during the beam scanning. For another example, the optical power of the light source such as a laser for producing the scanning beam can be adjusted to provide this position-dependent adjustment to the optical energy of optical pulses during the beam scanning. Whether to increase or decrease the optical energy of the beam at a particular location is dependent on specific local conditions associated with the perceived local brightness. The location conditions can include local distortions to the beam spot on the screen, and closeness between two adjacent beam spots on the screen in either two adjacent scan lines or in the same scan line.

Figure 24:
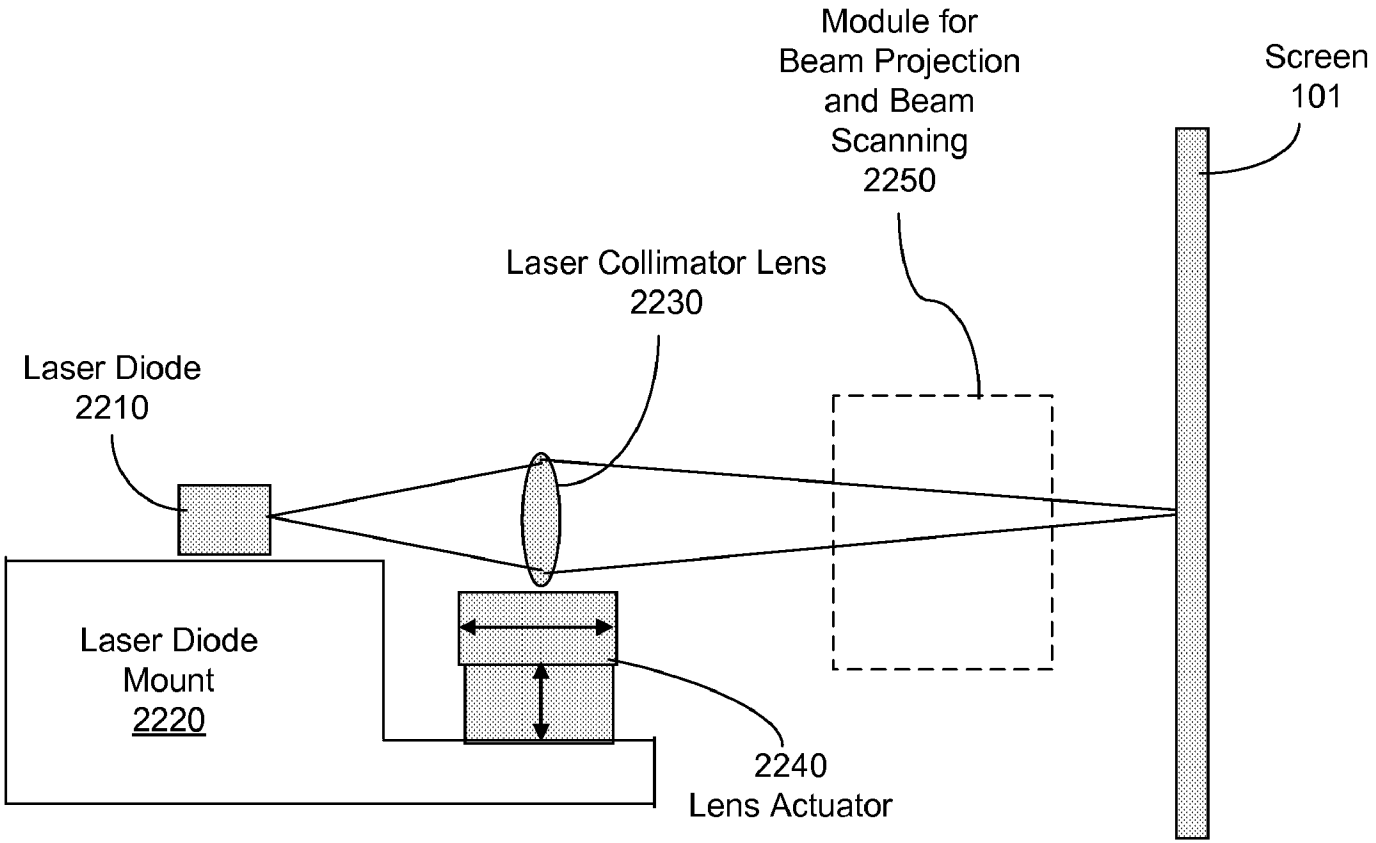
FIG. 24 shows one example of a laser actuator engaged to a collimator lens which is placed in front of a laser diode to collimate the laser beam.

In the above vertical servo feedback control for each individual laser, a laser actuator can be provided for each laser of multiple lasers that generate multiple scanning beams. Each laser actuator operates to adjust the vertical direction of the laser beam in response to the servo feedback and to place the beam at a desired vertical beam position along a fluorescent stripe on the screen. FIG. 24 shows one example of a laser actuator 2240 engaged to a collimator lens 2230 which is placed in front of a laser diode 2210 to collimate the laser beam produced by the laser 2210. The collimated beam out of the collimator lens 2230 is scanned and projected onto the screen 101 by a module for beam projection and beam scanning 2250 which includes, among other elements, the galvo mirror 340, the polygon scanner 350 and a scan lens 360 or 380. The laser diode 2210, the collimator lens 2230 and the lens actuator 2240 are mounted on a laser mount 2220. The lens actuator 2240 can adjust the vertical position of the collimator lens 2230 along the vertical direction that is substantially perpendicular to the laser beam. This adjustment of the collimator lens 2230 changes the vertical direction of the laser beam and thus the vertical beam position on the screen 101.

The above described techniques and devices that achieve dithered pixel brightness via temporal integration or spatial averaging beyond pixel brightness levels set by a DAC circuit module with preset levels can be implemented inv various other configurations. For example, the input control parameter to a light energy source can be determined based on the associated non-linear brightness output of the light energy source by applying a spatial and/or temporal dithering technique to produce output brightness within the linear brightness output region of the light energy source. In a device with two or more light energy sources that have different non-linear brightness output behaviors, each of these light energy sources can be controlled by using the spatial and/or temporal dithering technique to produce output brightness within the linear brightness output region of each light energy source.

The control techniques described here can be implemented in digital electronic circuitry, in tangibly-embodied computer software or firmware, in hardware, including the structures disclosed in this specification and their structural equivalents, or in combinations of one or more of them. Embodiments of the subject matter described in this specification can be implemented as one or more computer programs, i.e., one or more modules of computer program instructions encoded on a computer storage medium for execution by, or to control the operation of, data processing apparatus. Alternatively or in addition, the program instructions can be encoded on a propagated signal that is an artificially generated signal, e.g., a machine-generated electrical, optical, or electromagnetic signal, that is generated to encode information for transmission to suitable receiver apparatus for execution by a data processing apparatus. The computer storage medium can be a machine-readable storage device, a machine-readable storage substrate, a random or serial access memory device, or a combination of one or more of them.

The term "data processing apparatus" encompasses all kinds of apparatus, devices, and machines for processing data, including by way of example a programmable processor, a computer, or multiple processors or computers. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, or a combination of one or more of them.

A computer program (which may also be referred to as a program, software, software application, script, or code) can be written in any form of programming language, including compiled or interpreted languages, or declarative or procedural languages, and it can be deployed in any form, including as a standalone program or as a module, component, subroutine, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing or executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this document contains many specifics, these should not be construed as limitations on the scope of any invention or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Only a few implementations are disclosed. Variations and enhancements of the disclosed implementations and other implementations can be made based on what is described and illustrated in this document.

What is claimed is:

1. A device for producing light at different pixels displayed on a panel, comprising:

a panel;

a digital controller that produces digital pixel signals that represent, respectively, pixel brightness levels of pixels displayed on the panel;

a digital to analog conversion (DAC) circuit module configured to have preset DAC levels and coupled to the digital controller to receive the digital pixel signals, the DAC circuit module operable to convert the digital pixel signals into analog pixel signals at respective DAC levels;

a light producing module that emits light and receives the analog pixel signals to cause, by using the emitted light, illumination of individual pixels displayed on the panel based on respective DAC levels of the pixels, wherein the illumination of each individual pixel exhibits a stable brightness region in which each pixel produces stable illumination and an unstable brightness region in which each pixel produces unstable illumination; and a control mechanism that controls a block of a predetermined size of adjacent pixels displayed on the panel to selectively operate the DAC circuit module to cause one or more pixels in the block at a first DAC level and one or more other pixels in the block at a second DAC level different from the first DAC level to achieve a perceived spatial block average brightness level for the block between a first brightness level corresponding to the first DAC level and a second brightness level corresponding to the second DAC level where a difference between the first brightness level corresponding to the first DAC level and the second brightness level corresponding to the second DAC level represents a resolution limit of the DAC circuit module, the control mechanism further controlling the DAC circuit module, when a pixel within the block is to be dictated by a digital pixel signal to operate within a respective unstable brightness region, to operate one or more pixels in the block at a DAC level below the unstable brightness region and one or more other pixels in the block at a different DAC level above the respective unstable brightness region, to achieve a perceived spatial block brightness level within the respective unstable brightness region.

2. The device as in claim 1, wherein:

the first and second DAC levels are adjacent DAC levels.

3. The device as in claim 1, wherein:

the first and second DAC levels are separated by one or more DAC levels.

4. The device as in claim 1, wherein:

the digital controller generates the digital pixel signals for two or more sequential frames to produce an averaged frame which includes one or more predetermined sized blocks of adjacent pixels displayed on the panel to achieve a perceived average brightness level for each block between two brightness levels that correspond to the two different DAC levels.

5. The device as in claim 1, wherein:

in addition to selectively operating one or more pixels in the block at the first DAC level and one or more other pixels in the block at the second DAC level next to the first DAC level, the control mechanism is further configured to control the block of the predetermined size of adjacent pixels displayed on the panel to selectively operate one or more pixels in the block at a third DAC level that is different from the first and second DAC levels to achieve a perceived average brightness level for the block between a maximum brightness and a minimum brightness level of the brightness levels respectively corresponding to the first, second and third DAC levels.

6. The device as in claim 1, wherein:

the panel includes an array of light sources that are energized by the analog pixel signals, one light source per analog pixel signal, to emit light.

7. The device as in claim 6, wherein:

the light sources are semiconductor light sources.

8. The device as in claim 6, wherein:

the light sources are semiconductor light-emitting diodes.

9. The device as in claim 6, wherein:

the light sources are organic light-emitting diodes.

10. A device for producing light at different pixels displayed on a panel, comprising:

a panel;

a digital controller that produces digital pixel signals that represent, respectively, pixel brightness levels of pixels displayed on the panel;

a digital to analog conversion (DAC) circuit module configured to have preset DAC levels and coupled to the digital controller to receive the digital pixel signals, the DAC circuit module operable to convert the digital pixel signals into analog pixel signals at respective DAC levels;

a light producing module that receives the analog pixel signals to cause illumination of individual pixels displayed on the panel based on respective DAC levels of the pixels, wherein the illumination of each individual pixel exhibits a stable brightness region in which each pixel produces stable illumination and an unstable brightness region in which each pixel produces unstable illumination; and a control mechanism that controls a block of a predetermined size of adjacent pixels displayed on the panel to selectively operate the DAC circuit module to cause one or more pixels in the block at a first DAC level and one or more other pixels in the block at a second DAC level different from the first DAC level to achieve a perceived average brightness level for the block between a first brightness level corresponding to the first DAC level and a second brightness level corresponding to the second DAC level, the control mechanism further controlling the DAC circuit module, when a pixel within the block is to be dictated by a digital pixel signal to operate within a respective unstable brightness region, to operate one or more pixels in the block at a DAC level below the unstable brightness region and one or more other pixels in the block at a different DAC level above the respective unstable brightness region, to achieve a perceived brightness level within the respective unstable brightness region, the panel includes a fluorescent layer that absorbs an excitation light at a single excitation wavelength and emits visible light and includes a plurality of parallel fluorescent stripes elongated along a first direction and spaced from one another along a second direction perpendicular to the first direction, the analog pixel signals are applied to operate diode lasers to produce laser excitation beams of the excitation light of laser pulses at the single excitation wavelength, and the device further comprises a beam scanning module that scans the laser excitation beams along the second direction over the panel at different and adjacent screen positions along the first direction to produce different scan lines along the second direction, respectively, to cause the fluorescent layer of the panel to emit light in response to the laser pulses hitting respective pixel positions to produce respective pixel brightness levels in each scan line along the second direction.

11. The device as in claim 10, wherein:

at least three adjacent fluorescent stripes are made of three different fluorescent materials: a first fluorescent material that absorbs the excitation light and emits light of a first color, a second fluorescent material that absorbs the excitation light and emits light of a second color, and a third fluorescent material that absorbs the excitation light and emits light of a third color.

12. The device as in claim 1, wherein:

the panel is structured to transmit or reflect received light without producing light of its own, the analog pixel signals are applied to operate one or more laser to produce laser light of laser pulses, and the device further comprises a beam scanning module that scans the laser light on the panel to deliver the laser pulses at respective pixel positions on the panel to produce respective pixel brightness levels.

13. A device for producing light at different pixels displayed on a screen, comprising:

one or more light sources that produce one or more optical beams, each of the one or more light sources exhibiting a stable brightness region in which a respective light source produces stable illumination and an unstable brightness region in which a respective light source produces unstable illumination;

a screen that receives the one or more optical beams to display images carried by the optical beams; and a signal modulation controller in communication with the one or more light sources to cause the one or more optical beams to be modulated as optical pulses that carry images to be displayed, the signal modulation controller including a digital controller that produces digital pixel signals that represent, respectively, pixel brightness levels of pixels displayed on a screen and a digital to analog conversion (DAC) circuit module configured to have a preset DAC resolution between two different and adjacent DAC levels and coupled to the digital controller to receive the digital pixel signals, the DAC circuit module operable to convert the digital pixel signals into analog pixel signals at respective DAC levels; and an optical scanning module that scans the one or more optical beams onto the screen to direct the optical pulses onto respective pixel positions on the screen to produce respective pixel brightness levels, wherein the digital controller controls a block of a predetermined size of adjacent pixels displayed on the screen to selectively operate one or more pixels in the block at a first DAC level and one or more other pixels in the block at a second DAC level next to the first DAC level to achieve a perceived spatial block average brightness level for the block between a first brightness level corresponding to the first DAC level and a second brightness level corresponding to the second DAC level that differs from the first DAC level by the preset DAC resolution, and wherein the digital controller further controls the DAC circuit module, when a pixel is to be dictated by a digital pixel signal to operate within the unstable brightness region of the one or more light sources, to operate one or more pixels in the block at a DAC level below the unstable brightness region and one or more other pixels in the block at a different DAC level above the respective unstable brightness region, to achieve a perceived spatial block average brightness level within the respective unstable brightness region.

14. The device as in claim 13, wherein:

the screen includes an optical reference mark along a scanning path of an optical beam that is scanned on the screen to produce an optical signal of light indicating a position of the optical beam as being scanned on the screen, the device includes an optical detector located off the screen that collects light of the optical signal of light indicating the position of the optical beam and converts the collected light into a detector signal containing the position and timing of the optical beam at the optical reference mark, and the signal modulation controller uses the position and timing of the optical beam at the optical reference mark to control timing of the optical pulses for rendering the images on the screen.

15. The device as in claim 14, wherein:

the optical reference mark is a start of line reference mark that is located in a peripheral area on the screen that is outside an image displaying area where the images are displayed, and each optical beam is scanned through the start of line reference mark before reaching the image displaying area of the screen.

16. The device as in claim 14, wherein:

the optical reference mark is an end of line reference mark that is located in a peripheral area on the screen that is outside an image displaying area where the images are displayed, and each optical beam is scanned through the image displaying area of the screen before reaching the end of line reference mark.

17. The device as in claim 13, wherein:

the screen includes light-emitting regions that absorb light of the one or more optical beams to emit visible light forming the images.

18. The device as in claim 13, wherein:

each of the one or more optical beams is a beam of a visible color, and the screen renders the images by using the light of the visible color of each of the one or more optical beams without emitting new light.

19. A method for controlling brightness of pixels displayed on a panel, comprising:

providing digital pixel signals that represent, respectively, pixel brightness levels of pixels to be displayed on a panel;

operating a digital to analog conversion (DAC) circuit module that has preset DAC levels to convert the digital pixel signals into analog pixel signals at respective DAC levels;

applying the analog pixel signals to cause illumination of individual pixels displayed on the panel based on respective DAC levels of the pixels, wherein each individual pixel exhibits a stable brightness region in which each pixel produces stable illumination and an unstable brightness region in which each pixel produces unstable illumination; and selecting at least one pixel on the panel to operate the pixel at, at least, a first DAC level outside the unstable brightness region in a first frame and a second DAC level different from the first DAC level and outside the unstable brightness region at a second frame at a time after the first frame, to achieve a perceived temporal average brightness level for the pixel, which is collectively produced by combining the first and second frames, to be between a first brightness level corresponding to the first DAC level and a second brightness level corresponding to the second DAC level, wherein, when a perceived brightness level for a pixel is to be at a level within a respective unstable region, the first DAC level is selected to be below the unstable region and the second DAC level is outside is selected to be above the unstable region.

20. The method as in claim 19, comprising:

selecting a block of adjacent pixels displayed on the panel to selectively operate one or more first pixels in the block at a one DAC level and one or more second pixels in the block at a another different DAC level to achieve a perceived spatial block average brightness level for the block.

21. The method as in claim 19, wherein:

the panel includes an array of light sources that are energized by the analog pixel signals, one light source per analog pixel signal, to emit light.

22. The method as in claim 21, wherein:

the light sources are semiconductor light sources.

23. The method as in claim 21, wherein:

the light sources are semiconductor light-emitting diodes.

24. The method as in claim 21, wherein:

the light sources are organic light-emitting diodes.

25. The method as in claim 19, wherein:

the panel includes a fluorescent layer that absorbs an excitation light at a single excitation wavelength and emits visible light and includes a plurality of parallel fluorescent stripes elongated along a first direction and spaced from one another along a second direction perpendicular to the first direction; and the method further comprises:

applying the analog pixel signals to operate diode lasers to produce laser excitation beams of the excitation light of laser pulses at the single excitation wavelength; and scanning the laser excitation beams along the second direction over the panel at different and adjacent screen positions along the first direction to produce different scan lines along the second direction, respectively, to cause the fluorescent layer of the panel to emit light in response to the laser pulses hitting respective pixel positions to produce respective pixel brightness levels in each scan line along the second direction.

26. A device for producing light at different pixels displayed on a panel, comprising:

a panel;

a digital controller that produces digital pixel signals that represent, respectively, pixel brightness levels of pixels projected onto or formed on the panel;

a digital to analog conversion (DAC) circuit module configured to have preset DAC levels and coupled to the digital controller to receive the digital pixel signals, the DAC circuit module operable to convert the digital pixel signals into analog pixel signals at respective DAC levels;

a light producing module which emits light and is coupled to receive the analog pixel signals from the DAC circuit module and to cause, by using the emitted light, illumination of individual pixels displayed on the panel based on respective DAC levels of the pixels, wherein each individual pixel exhibits a stable brightness region in which each pixel produces stable illumination and an unstable brightness region in which each pixel produces unstable illumination; and a control mechanism that selects at least one pixel on the panel to operate the pixel at, at least, a first DAC level outside the unstable region in a first frame and a second DAC level outside the unstable region and different from the first DAC level at a second frame at a time after the first frame, to achieve a perceived temporal average brightness level for the pixel collectively produced by combining the first and second frames to be between a first brightness level corresponding to the first DAC level and a second brightness level corresponding to the second DAC level, wherein, when a perceived brightness level for a pixel is to be at a level within a respective unstable region, the control mechanism selects the first DAC level to be below the unstable region and the second DAC level to be above the unstable region.

27. The device as in claim 26, wherein:

the panel includes a fluorescent layer that absorbs an excitation light at a single excitation wavelength and emits visible light and includes a plurality of parallel fluorescent stripes elongated along a first direction and spaced from one another along a second direction perpendicular to the first direction, the analog pixel signals are applied to operate diode lasers to produce laser excitation beams of the excitation light of laser pulses at the single excitation wavelength, and the device further comprises a beam scanning module that scans the laser excitation beams along the second direction over the panel at different and adjacent screen positions along the first direction to produce different scan lines along the second direction, respectively, to cause the fluorescent layer of the panel to emit light in response to the laser pulses hitting respective pixel positions to produce respective pixel brightness levels in each scan line along the second direction.

* * * * *